US007030844B2

(12) United States Patent
Kang et al.

(10) Patent No.: US 7,030,844 B2
(45) Date of Patent: Apr. 18, 2006

(54) APPARATUS AND METHOD DATA-DRIVING FOR LIQUID CRYSTAL DISPLAY DEVICE

(75) Inventors: Sin Ho Kang, Kyonggi-do (KR); Seung Kuk Ahn, Kyongsangbuk-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 395 days.

(21) Appl. No.: 10/422,963

(22) Filed: Apr. 25, 2003

(65) Prior Publication Data

US 2004/0104873 A1 Jun. 3, 2004

(30) Foreign Application Priority Data

Dec. 3, 2002 (KR) ..... P10-2002-0076357

(51) Int. Cl.
*G09G 3/36* (2006.01)

(52) U.S. Cl. ..... 345/87; 345/100; 345/204

(58) Field of Classification Search ..... 345/87, 345/42, 89, 98, 99, 100, 204, 51, 61, 103
See application file for complete search history.

(56) References Cited

U.S. PATENT DOCUMENTS 6,008,801 A * 12/1999 Jeong ..... 345/204
6,097,362 A * 8/2000 Kim ..... 345/87
2001/0050665 A1 12/2001 Yeo et al.
2003/0090451 A1 * 5/2003 Ahn ..... 345/96
2004/0104880 A1 * 6/2004 Kang et al. ..... 345/94

* cited by examiner

*Primary Examiner*—Regina Liang
*Assistant Examiner*—Jennifer T. Nguyen
(74) *Attorney, Agent, or Firm*—McKenna Long & Aldridge LLP

(57) ABSTRACT

An apparatus and method for data-driving a liquid crystal display device is disclosed in the present invention. The data-driving apparatus for a liquid crystal display device includes a first multiplexer array performing a time-division on inputted pixel data, alternately changing a supplying sequence of the time-divided pixel data for one horizontal period and one frame, and supplying the time-divided pixel data, a second multiplexer array alternately changing output channels of the pixel data for at least two horizontal periods, a digital-to-analog converter array converting the pixel data into analog pixel signals having a polarity opposite to the pixel data of adjacent channels, a third multiplexer array alternately changing output channels of the pixel signals for each at least two horizontal periods, and a demultiplexer array performing a time-division on data lines, alternately changing a supplying sequence of the pixel signals for at least one horizontal period and one frame, and supplying the pixel signals to the time-divided data lines.

24 Claims, 22 Drawing Sheets

B G R B G R B G R

B G R B G R B G R

B G B R G B R G B R

B G R G B R G B R G B

R G B R G B R G B

R G B R G B R G B

APPARATUS AND METHOD DATA-DRIVING FOR LIQUID CRYSTAL DISPLAY DEVICE

This application claims the benefit of the Korean Patent Application No. P2002-076357 filed on Dec. 3, 2002, which is hereby incorporated by reference.

BACKGROUND OF THE INVENTION

1. Field of the Invention

The present invention relates to a liquid crystal display device, and more particularly, to an apparatus and method for data-driving a liquid crystal display device. Although the present invention is suitable for a wide scope of applications, it is particularly suitable for reducing the number of data driver integrated circuits for driving data lines on a time-division basis.

2. Discussion of the Related Art

Generally, a liquid crystal display (LCD) device controls light transmittance of a liquid crystal using an electric field to display a picture. To this end, the LCD includes a liquid crystal display panel having liquid crystal cells arranged in an active matrix type, and a driving circuit for driving the liquid crystal display panel.

An LCD according to the related art, as shown in FIG. 1, includes data-driving IC's 4 connected through data tape carrier packages (TCP's) 6 to a liquid crystal display panel 2, and gate driving IC's 8 connected through gate TCP's 10 to the liquid crystal display panel 2.

More specifically, the liquid crystal display panel 2 includes a thin film transistor TFT formed at an intersection of a gate line and a data line, and a liquid crystal cell connected to the TFT. A gate electrode of the TFT is connected to one of the gate lines being vertical lines, and a source electrode is connected to one of the data lines being horizontal lines. Such a TFT responds to a scanning signal from the gate line to supply a pixel signal from the data line to the liquid crystal cell. The liquid crystal cell includes a pixel electrode connected to a drain electrode of the TFT and a common electrode facing into the pixel electrode with a liquid crystal therebetween. Such a liquid crystal cell responds to the pixel signal supplied to the pixel electrode to drive the liquid crystal, thereby controlling its light transmittance.

Each of the gate driving IC's 8 is mounted on the gate TCP 10. The gate driving IC's 8 mounted on the gate TCP 10 are electrically connected to the corresponding gate pads of the liquid crystal display panel 2 through the gate TCP 10. The gate driving IC's 8 sequentially drive the gate lines of the liquid crystal display panel 2 for each horizontal period 1H.

Each of the data-driving IC's 4 is mounted on the data TCP 6. The data-driving IC's 4 mounted on the data TCP 6 are electrically connected to the corresponding data pads of the liquid crystal display panel 2 through the data TCP 6. The data-driving IC's 4 convert digital pixel data into an analog pixel signal and supply to the data lines of the liquid crystal display panel 2 for each horizontal period 1H.

To this end, as shown in FIG. 2, each of the data-driving IC's 4 includes a shift register 12 for applying a sequential sampling signal, first and second latch arrays 16 and 18 for latching and outputting a pixel data VD in response to the sampling signal, a first multiplexer (MUX1) array 15 arranged between the first and second latch arrays 16 and 18, a digital-to-analog converter (DAC) array 20 for converting the pixel data from the second latch array 18 into a pixel signal, a buffer array 26 for buffering and outputting the pixel signal from the DAC array 20, and a second multiplexer (MUX2) array 30 for selecting a path of an output of the buffer array 26. Further, the data-driving IC 4 includes a data register 34 for interfacing pixel data (R, G, and B) from a timing controller (not shown), and a gamma voltage part 36 for supplying positive and negative gamma voltages required in the DAC array 20.

Each data-driving IC 4 having the configuration as mentioned above has n channel (e.g., 384 or 480 channel) data outputs to drive n data lines. FIG. 2 illustrates only 6 channels D1 to D6 of the n channels of the data-driving IC 4.

The data register 34 interfaces the pixel data from the timing controller and applies the pixel data to the first latch array 16. Particularly, the timing controller divides the pixel data into even pixel data RGBeven and odd pixel data RGBodd for the purpose of reducing a transmission frequency and supplies the divided pixel data through each transmission line to the data register 34. The data register 34 outputs the input even and odd pixel data RGBeven and RGBodd to the first latch array 16 over each transmission line. Herein, each of the even pixel data RGBeven and the odd pixel data RGBodd includes red(R), green(G), and blue(B) pixel data.

The gamma voltage part 36 further divides a plurality of gamma reference voltages from a gamma reference voltage generator (not shown) for each gray level and output the divided voltages.

The shift register array 12 generates a plurality of sequential sampling signals and applies the sampling signals to the first latch array 16. To this end, the shift register array 12 is comprised of n/6 shift registers 14. The shift register 14 at the first stage in FIG. 2 shifts a source start pulse SSP from the timing controller in response to a source sampling clock signal SSC to output the shifted source start pulse as a sampling signal. At the same time, the shift register 14 applies the sampling signal to the shift register 14 at the next stage as a carry signal CAR. The source start pulse SSP is applied for each horizontal period 1H, as shown in FIGS. 3A and 3B, and is shifted every source sampling clock signal SSC to be outputted as a sampling signal.

The first latch array 16 samples and latches the pixel data RGBeven and RGBodd from the data register 34 by a certain unit in response to the sampling signal from the shift register array 12. The first latch array 16 consists of n first latches 13 for latching n pixel data R, G, and B, each of which has a size corresponding to the bit number (i.e., 3 bits or 6 bits) of the pixel data R, G, and B. Such a first latch array 16 samples and latches the even pixel data RGBeven and the odd pixel data RGBodd (i.e., each 6 pixel data) for each sampling signal, and then outputs the latched data simultaneously.

The MUX1 array 15 determines a path of the pixel data R, G, and B supplied from the first latch array 16 in response to a polarity control signal POL from the timing controller. To this end, the MUX1 array 15 includes (n−1) MUX1s 17. Each of the MUX1s 17 receives output signals of the two adjacent first latches 13 to selectively output the signals in response to the polarity control signal POL. Herein, the outputs of the remaining first latches 13 excluding the first and last first latches 13 are commonly inputted to the two adjacent MUX1s 17. The outputs of the first and last first latches 13 are commonly inputted to the second latch array 18 and the MUX1 17. The MUX1 array 15 having the configuration as mentioned above allows the pixel data R, G, and B from each first latch 13 to be advanced into the second latch array 18 as they are, or to be progressed into the second latch array 18 with being shifted toward the right side by one position in response to the polarity control signal POL. The polarity control signal POL has a polarity inverted for each horizontal period 1H, as shown in FIGS. 3A and 3B. As a result, the MUX1 array 15 allows each pixel data R, G, and B from the first latch array 16 to be outputted through the second latch array 18 to a positive (P) DAC 22 or a negative (N) DAC 24 of the DAC array 20 in response to the polarity control signal POL, thereby controlling the polarities of the pixel data R, G, and B.

The second latch array 18 simultaneously latches the inputted pixel data R, G, and B through the MUX1 array 15, from the first latch array 16 in response to a source output enable signal SOE from the timing controller, and then outputs the latched pixel data. Particularly, the second latch array 18 includes (n+1) second latches 19 in consideration of the pixel data R, G, and B from the first latch array 16 inputted with being shifted to the right. The source output enable signal SOE is generated for each horizontal period 1H, as shown in FIGS. 3A and 3B. The second latch array 18 simultaneously latches the pixel data R, G, and B inputted at the rising edge of the source output enable signal SOE, and simultaneously outputs the latched pixel data at the falling edge thereof.

The DAC array 20 converts the pixel data R, G, and B from the second latch array 18 into pixel signals by using positive and negative gamma voltages GH and GL from the gamma voltage part 36 to output the pixel signals. To this end, the DAC array 20 includes (n+1) PDAC's 22 and (n+1) NDAC's 24, which are alternately arranged in parallel to each other. The PDAC 22 converts the pixel data R, G, and B from the second latch array 18 into positive pixel signals using the positive gamma voltages GH. On the other hand, the NDAC 24 converts the pixel data R, G, and B from the second latch array 18 into negative pixel signals using the negative gamma voltages GL. Each of (n+1) buffers 28 is included in the buffer array 26 buffers and outputs a pixel signal from each of the PDAC's 22 and the NDAC's 24 of the DAC array 20.

The MUX2 array 30 determines a path of each pixel signal from the buffer array 26 in response to the polarity control signal POL from the timing controller. To this end, the MUX2 array 30 includes n MUX2s 32. Each of the MUX2s 32 selects any one output of the two adjacent buffers 28 in response to the polarity control signal POL and outputs the selected signal to the corresponding data line DL. Herein, the outputs of the remaining buffers 28 excluding the first and last buffers 28 are commonly inputted to the two adjacent MUX2s. The MUX2 array 30 having the configuration as mentioned above allows the pixel signals from the buffers 28 excluding the last buffer 28 to be outputted to the data lines D1 to D6 as they are at a corresponding one-to-one relationship in response to the polarity control signal POL. Further, the MUX2 array 30 allows the pixel signals from the remaining buffers 28 excluding the first buffer 28 to be outputted to the data lines D1 to D6 with being shifted toward the left side by one position at a corresponding one-to-one relationship in response to the polarity control signal POL. The polarity control signal POL has a polarity inverted for each horizontal period 1H, as shown in FIGS. 3A and 3B, similar to the MUX1 array 15. As mentioned above, the MUX2 array 30, along with the MUX1 array 15, determines polarities of the pixel signals applied to the data lines D1 to D6 in response to the polarity control signal POL. As a result, the pixel signal applied through the MUX2 array 30 to each data line D1 to D6 has a polarity opposite to the adjacent pixel signals. In other words, as shown in FIGS. 3A and 3B, the pixel signals outputted to the odd data lines DLodd, such as D1, D3 and D5, etc., have polarities opposite to the pixel signals outputted to the even data lines DLeven, such as D2, D4 and D6, etc. Polarities of the odd data lines DLodd and the even data lines DLeven are inverted for each horizontal period 1H at which the gate lines GL1, GL2, GL3, . . . are sequentially driven, and are inverted for each frame.

As described above, each of the related art data-driving IC's 4 requires (n+1) DAC's and (n+1) buffers so as to drive n data lines. As a result, the related art data-driving IC's 4 have disadvantages in that the configuration are complex and the manufacturing costs are relatively high.

SUMMARY OF THE INVENTION

Accordingly, the present invention is directed to an apparatus and method for data-driving a liquid crystal display device that substantially obviates one or more of problems due to limitations and disadvantages of the related art.

Another object of the present invention is to provide an apparatus and method for data-driving a liquid crystal display device that is adaptive for reducing the number of data driver integrated circuits and improving its picture display quality by driving data lines on a time-division basis.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an apparatus for data-driving a liquid crystal display device includes a first multiplexer array performing a time-division on inputted pixel data, alternately changing a supplying sequence of the time-divided pixel data for one horizontal period and one frame, and supplying the time-divided pixel data, a second multiplexer array alternately changing output channels of the pixel data for at least two horizontal periods, a digital-to-analog converter array converting the pixel data into analog pixel signals having a polarity opposite to the pixel data of adjacent channels, a third multiplexer array alternately changing output channels of the pixel signals for each at least two horizontal periods, and a demultiplexer array performing a time-division on data lines, alternately changing a supplying sequence of the pixel signals for at least one horizontal period and one frame, and supplying the pixel signals to the time-divided data lines.

The data-driving apparatus further includes a shift register array sequentially generating sampling signals, a latch array sequentially latching the inputted pixel data in response to the sampling signals and simultaneously outputting the latched pixel data to the first multiplexer array, and a buffer array buffering the pixel signals from the digital-to-analog converter array and applying the buffered pixel signals to the third multiplexer array.

The second multiplexer array outputs unshifted pixel data for the at least two horizontal periods or outputs the pixel data shifted to the right side by one channel, and the third multiplexer array outputs the pixel signals for the at least two horizontal periods without a change or after shifting the pixel data to the left side by one channel.

The digital-to-analog converter array includes (n+1) number of positive and negative digital-to-analog converters when the demultiplexer array drives 2n data lines, and the positive digital-to-analog converters and the negative digital-to-analog converters are alternately arranged.

Herein, the first multiplexer array includes at least n number of first multiplexers performing an n number of time-division on 2n pixel data and supplying the time-divided pixel data, the second multiplexer array includes at least (n−1) number of second multiplexers selecting one of outputs of at least two first multiplexers, the third multiplexer array includes at least n number of third multiplexers selecting one of outputs of at least two digital-to-analog converters, the demultiplexer array includes at least n number of demultiplexers dividing an output of each third multiplexer and supplying the divided output to at least two data lines, the output of each first multiplexer is commonly inputted to at least two second multiplexers, and the output of each digital-to-analog converter is commonly inputted to at least two third multiplexers.

Herein, each odd-numbered first multiplexer selects one of at least two odd-numbered pixel data in response to a first selection control signal and outputs the selected pixel data, and each even-numbered first multiplexer selects one of at least two even-numbered pixel data in response to a second selection control signal and outputs the selected pixel data, and each odd-numbered demultiplexer performs a time-division on a pixel signal from an odd-numbered third multiplexer in response to the first selection control signal and outputs the time-divided pixel signals to at least two odd-numbered data lines, and each even-numbered demultiplexer performs a time-division on a pixel signal from an even-numbered third multiplexer in response to the second selection control signal and outputs the time-divided pixel signals to at least two even-numbered data lines.

The first and second selection control signals have polarities opposite to each other, and the polarities of the first and second selection control signals are inverted for one horizontal period in order to change an output sequence of the pixel data and the pixel signals for the one horizontal period and the one frame.

In another aspect of the present invention, a data-driving apparatus for a liquid crystal display device includes a data register exchanging pixel data to be supplied to the $(4k-3)^{th}$ (i.e., k is a positive integer) data line among inputted pixel data with pixel data to be supplied to the $(4k-2)^{th}$ data line and realigning the exchanged pixel data, a first multiplexer array performing a time-division on the pixel data from the data register, alternately changing a supplying sequence of the time-divided pixel data for each horizontal period and each frame, and supplying the time-divided pixel data, a digital-to-analog converter array converting the pixel data into analog pixel signals having a polarity opposite to pixel data of adjacent channels, a second multiplexer array alternately changing output channels of the pixel signals for each at least two horizontal periods, and a demultiplexer array performing a time-division on data lines, alternately changing a supplying sequence of the pixel signals for at least one horizontal period and one frame, and supplying the pixel signals to the time-divided data lines.

The data register outputs the realigned pixel data for the at least two horizontal periods, and delays the realigned pixel data by two channels to output the delayed pixel data for the next at least two horizontal periods.

The data-driving apparatus further includes a shift register array sequentially generating sampling signals, a latch array sequentially latching the inputted pixel data from the data register in response to the sampling signals and simultaneously outputting the latched inputted pixel data to the first multiplexer array, and a buffer array buffering the pixel signals from the digital-to-analog converter array and applying the buffered pixel signals to the second multiplexer array.

The second multiplexer array outputs unshifted pixel data for the at least two horizontal periods or outputs the pixel data shifted to the left side by one channel.

The digital-to-analog converter array includes (n+1) number of positive and negative digital-to-analog converters when the demultiplexer array drives 2n data lines, and the positive digital-to-analog converters and the negative digital-to-analog converters are alternately arranged.

The first multiplexer array includes at least n number of first multiplexers performing an n number of time-division on 2n pixel data in response to a selection control signal and supplying the time-divided pixel data, the second multiplexer array includes at least n number of second multiplexers selecting one of outputs of at least two digital-to-analog converters in response to a polarity control signal, the demultiplexer array includes at least n number of demultiplexers dividing an output of each second multiplexer in response to the selection control signal and supplying the divided outputs to at least two data lines, and the output of each digital-to-analog converter is commonly inputted to at least two second multiplexers.

The selection control signal has a polarity inverted for each horizontal period and each frame in order to change an output sequence of the pixel data and the pixel signals.

In another aspect of the present invention, a data-driving method for a liquid crystal display device includes performing a time-division on inputted pixel data in response to a selection control signal, alternately changing a supplying sequence of the time-divided pixel data for at least one horizontal period and one frame, and supplying the time-divided pixel data, sustaining an output channel of unshifted pixel data or shifting the pixel data to the right side by one channel in accordance with a polarity control signal having a polarity inverted for at least two horizontal periods, and outputting the pixel data, converting the pixel data into analog pixel voltage signals, sustaining an output channel of unshifted pixel signals or shifting the pixel signals to the left side by one channel, and outputting the pixel signals, and performing a time-division on a plurality of data lines in response to the selection control signal and supplying the pixel signals to the time-divided data lines, and alternately changing a supplying sequence of the pixel signals for at least one horizontal period and one frame and supplying the pixel signals.

The data-driving method further includes sequentially generating sampling signals prior to performing a time-division on the pixel data and supplying the time-divided pixel data, sequentially latching the pixel data in response to the sample signals, and simultaneously supplying the latched pixel data, and buffering the pixel signals after converting into the pixel signals.

The performing a time-division on the pixel data includes separating the pixel data into odd-numbered pixel data and even-numbered pixel data and performing a time-division on the separated pixel data.

The performing a time-division on the data lines includes separating the data lines into odd-numbered data lines and even-numbered data lines and performing a time-division on the separated data lines.

In a further aspect of the present invention, a data-driving method for a liquid crystal display device includes exchanging pixel data to be supplied to the $(4k-3)^{th}$ (i.e., k is a positive integer) data line among inputted pixel data with pixel data to be supplied to the $(4k-2)^{th}$ data line and realigning the exchanged pixel data, performing a time-division on the realigned pixel data in response to a selection control signal, alternately changing a supplying sequence of the time-divided pixel data for each horizontal period and each frame, and supplying the time-divided pixel data, converting the pixel data into analog pixel voltage signals having polarities opposite to pixel data of adjacent channels, sustaining an output channel of unshifted pixel signals or shifting the pixel signals to the left side by one channel in accordance with a polarity control signal having a polarity inverted for at least two horizontal periods, and outputting the pixel signals, and performing a time-division on a plurality of data lines in response to the selection control signal and supplying the pixel signals to the time-divided data lines, and alternately changing a supplying sequence of the pixel signals for at least one horizontal period and one frame and supplying the pixel signals.

The data-driving method further includes sequentially generating sampling signals prior to performing a time-division on the pixel data and supplying the time-divided pixel data, sequentially latching the realigned pixel data in response to the sample signals, and simultaneously applying the latched pixel data, and buffering the pixel signals after converting into the pixel signals.

The realigning the pixel data further includes outputting the realigned pixel data for at least two horizontal periods, and delaying the realigned pixel data by two channels to output the delayed pixel data for the next at least two horizontal periods.

The selection control signal has a polarity inverted for each horizontal period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

With reference to FIGS. 4 to 13B, the present invention will be explained as follows.

Figure 1:
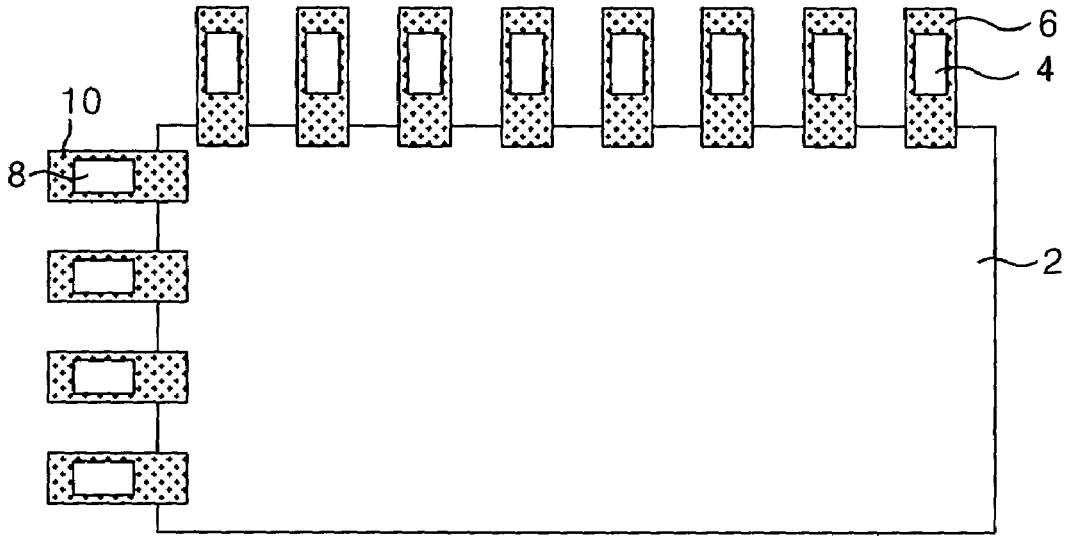
FIG. 1 RELATED ART
FIG. 1 is a schematic view showing a configuration of a related art liquid crystal display device.
Figure 2:
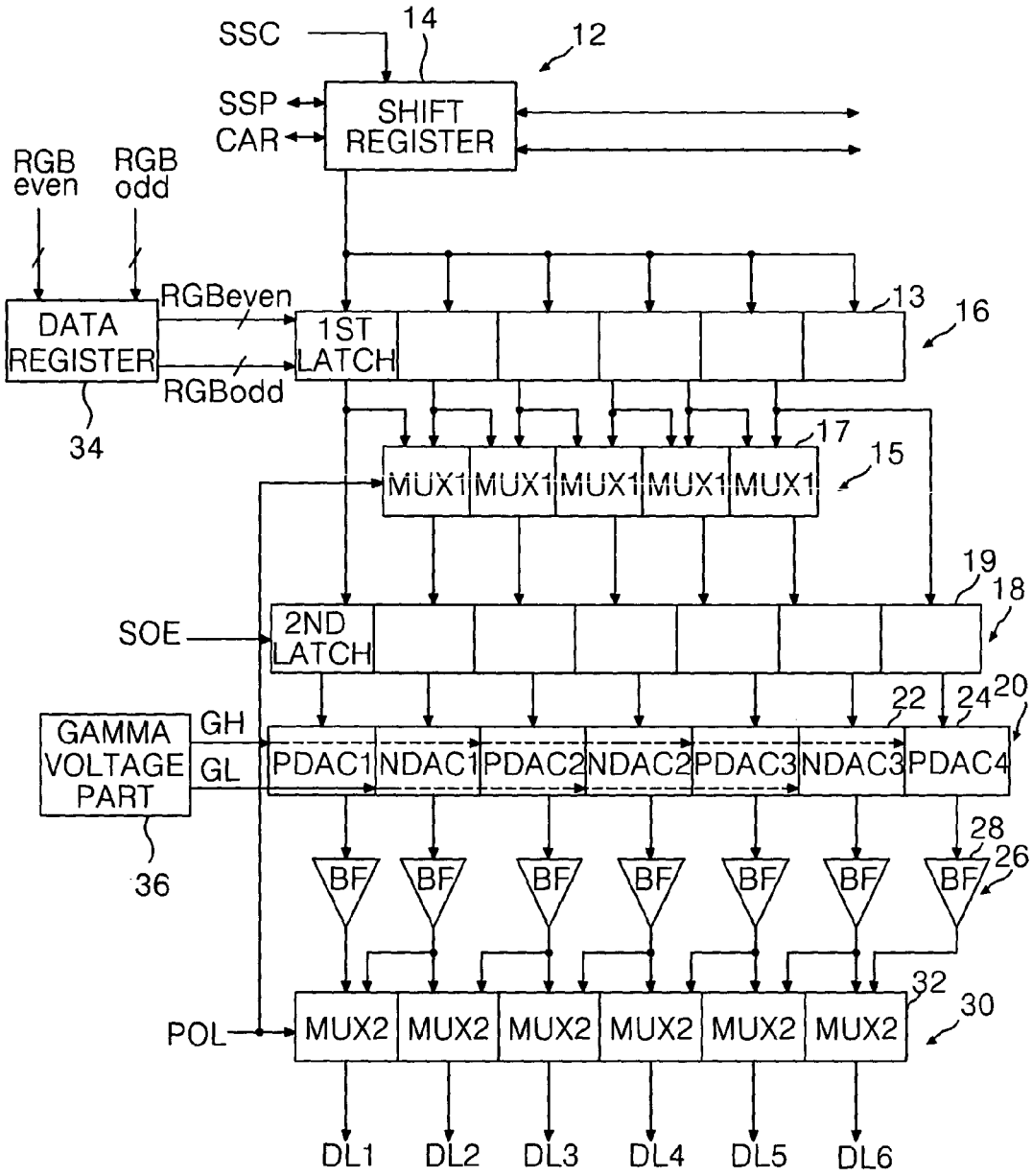
FIG. 2 RELATED ART
FIG. 2 is a detailed block diagram of the data-driving integrated circuit of FIG. 1.
Figure 3A:
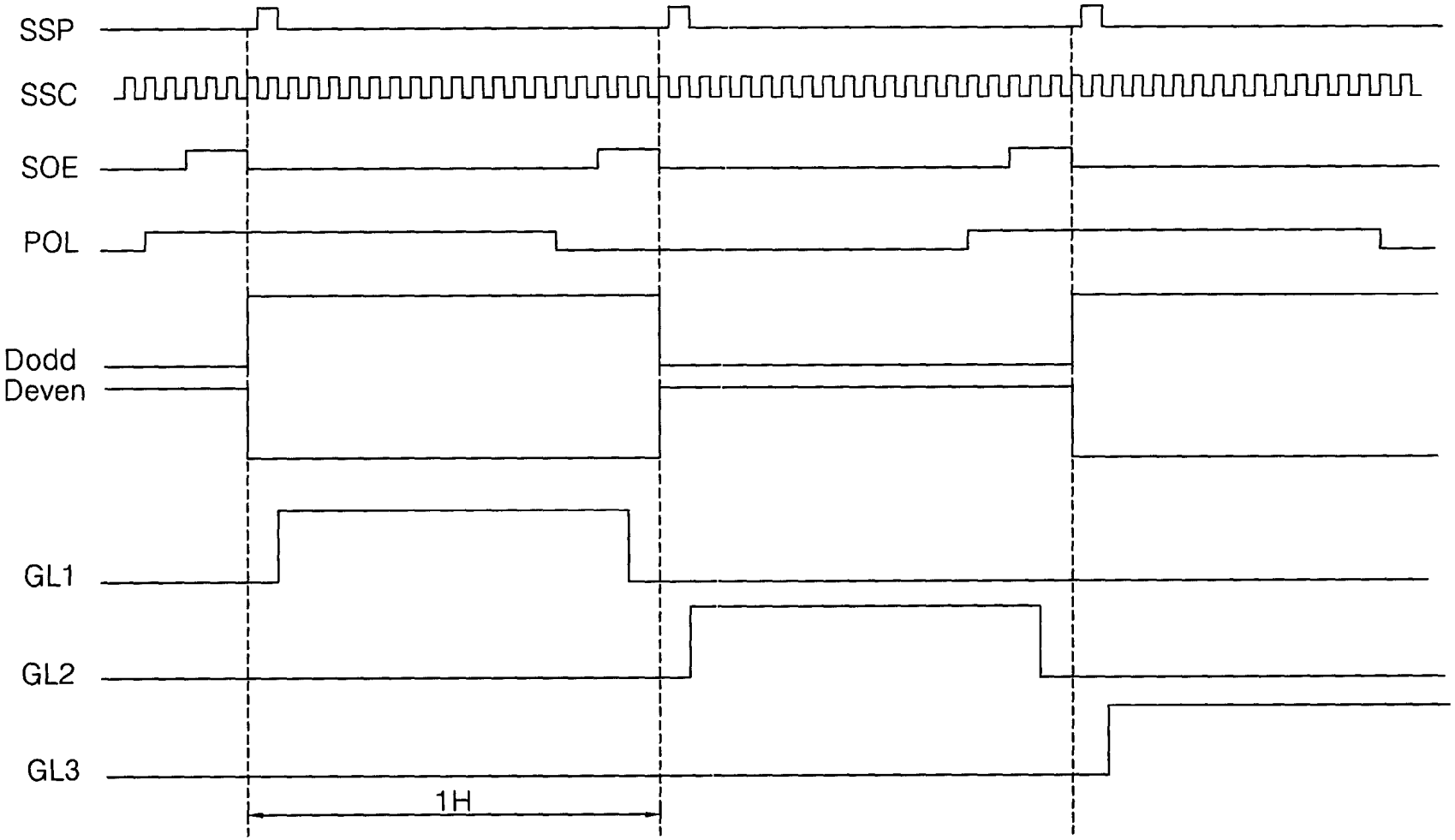
FIG.3A RELATED ART
FIGS. 3A and 3B are driving waveform diagrams of odd and even frames of the data-driving IC of FIG. 2.
Figure 3B:
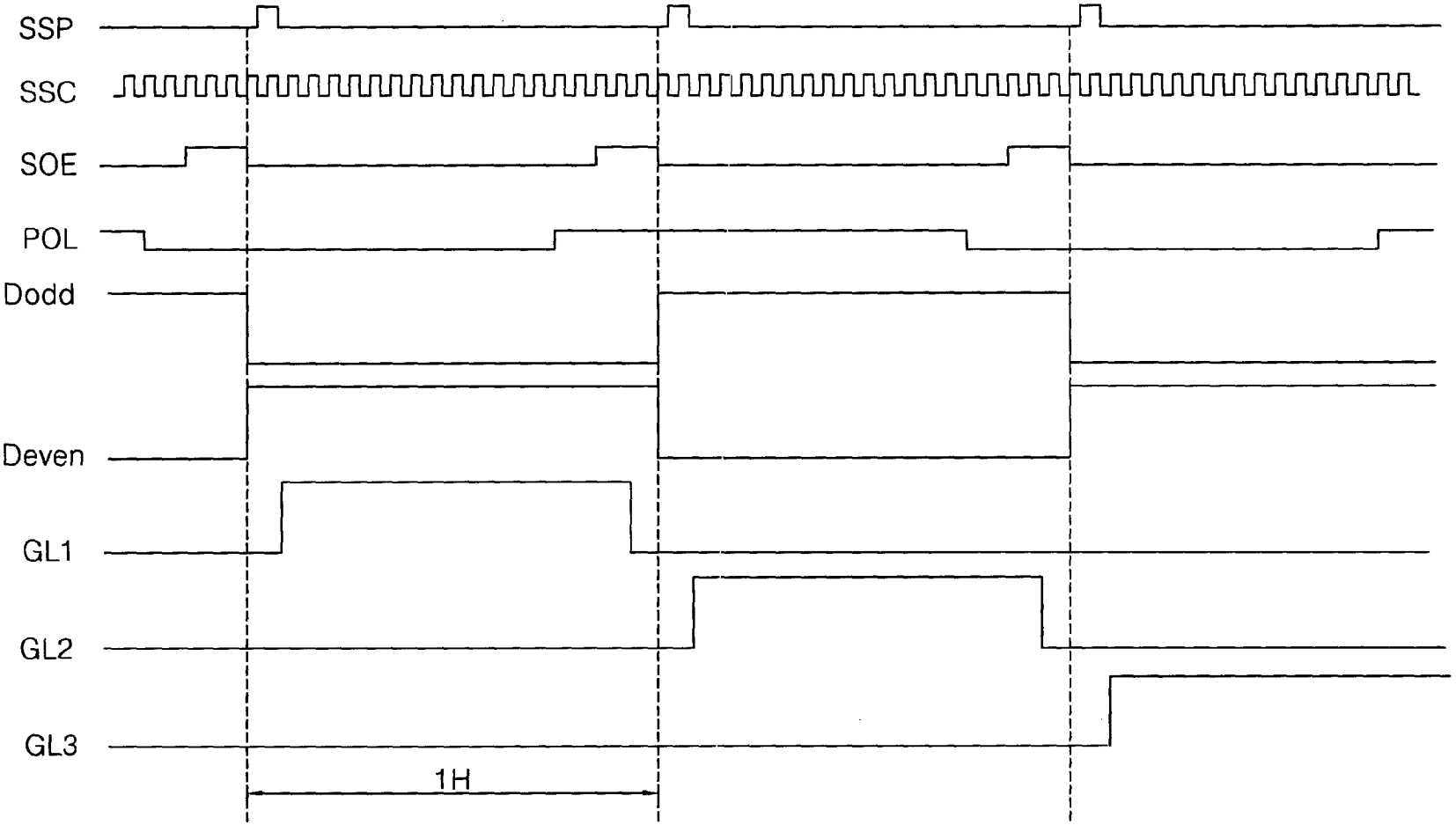
FIG.3B RELATED ART
Figure 4:
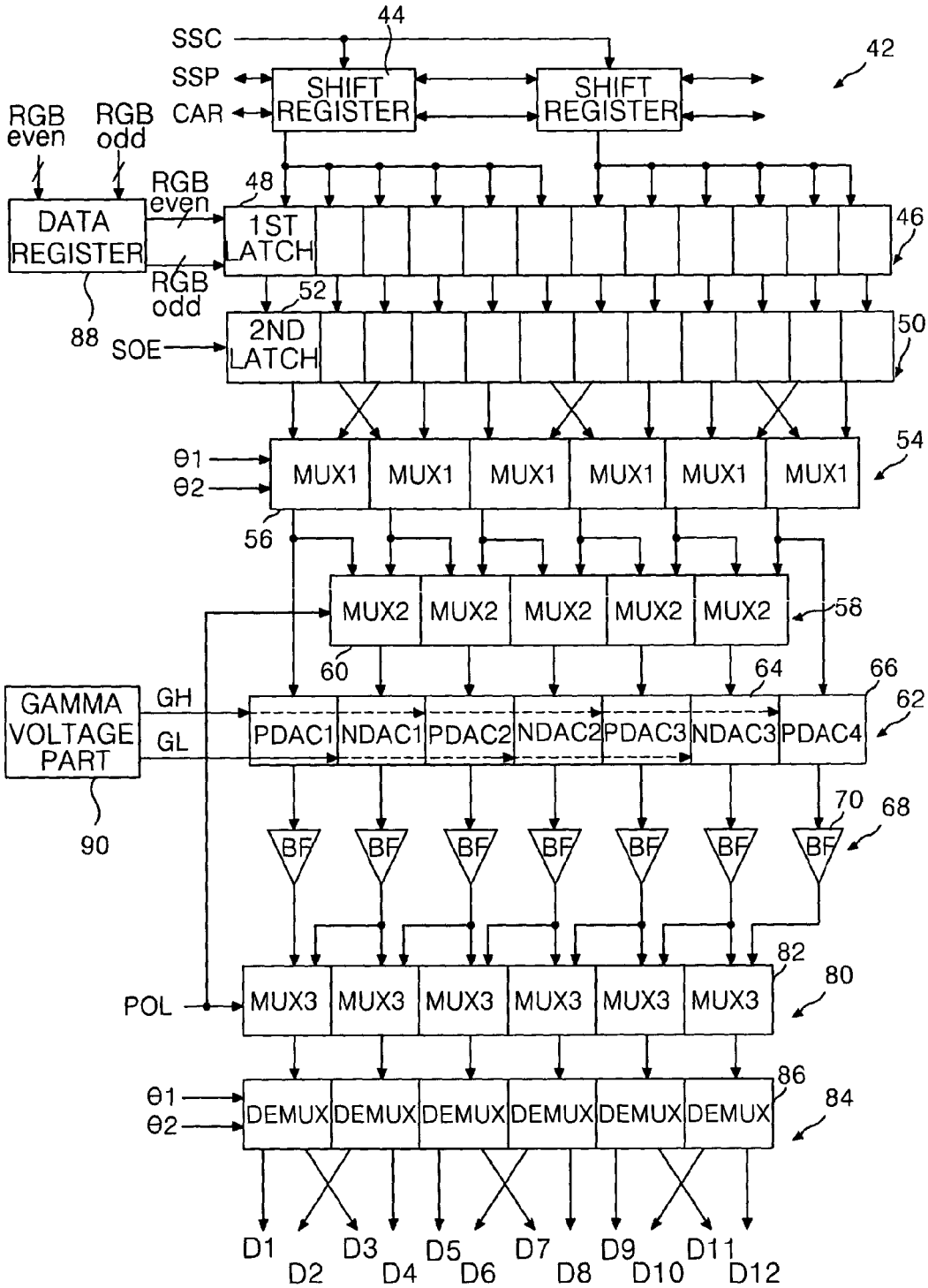
FIG. 4 is a detailed block diagram showing a configuration of a data-driving IC of a liquid crystal display device according to a first embodiment of the present invention.
Figure 5A:
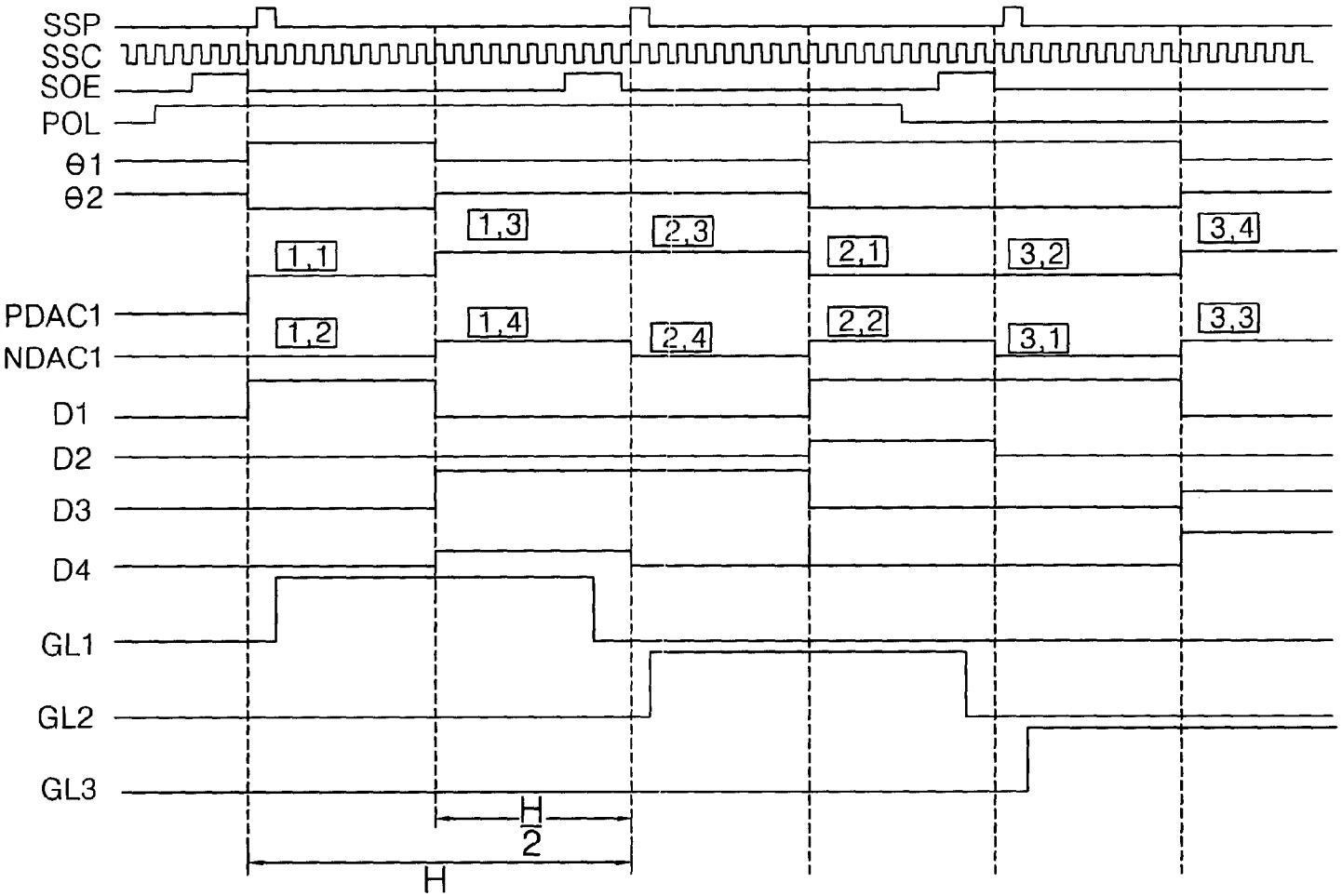
FIGS. 5A and 5B are driving waveform diagrams of odd and even frames of the data-driving IC of FIG. 4.
Figure 5B:
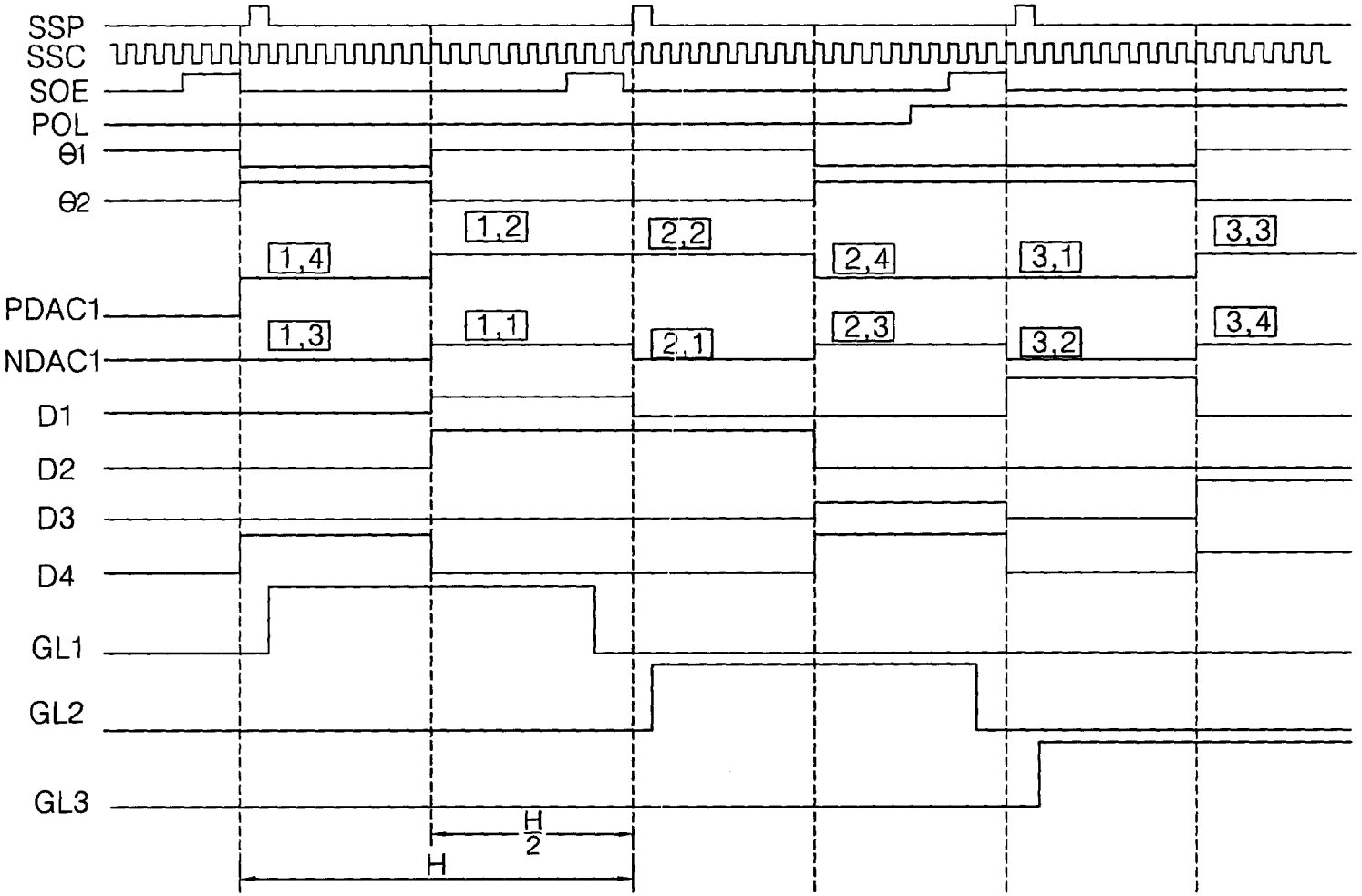

In FIG. 4 is a detailed block diagram of a configuration of a data-driving IC of a liquid crystal display device according to a first embodiment of the present invention. FIGS. 5A and 5B are driving waveform diagrams of odd and even frames of the data-driving IC of FIG. 4.

The data-driving IC, as shown in FIG. 4, includes a shift register array 42 for applying a sequential sampling signal, first and second latch arrays 46 and 50 for latching and outputting pixel data R, G, and B in response to the sampling signal, a first multiplexer (MUX1) array 54 for time-dividing the pixel data R, G, and B from the second latch array 50 and outputting the time-divided pixel data, a second multiplexer (MUX2) array 58 for controlling a path of the pixel data R, G, and B from the MUX1 array 54, a digital-to-analog converter (DAC) array 62 for converting the pixel data R, G, and B from the MUX2 array 58 into pixel signals, a buffer array 68 for buffering and outputting the pixel signals from the DAC array 62, a third multiplexer array (MUX3) 80 for controlling a path of an output of the buffer array 68, and a demultiplexer (DEMUX) array 84 for time-dividing the pixel signals from the third multiplexer array (MUX3) 80 and outputting into data lines D1 to D2n. Further, the data-driving IC, shown in FIG. 4, includes a data register 88 for interfacing pixel data R, G, and B from a timing controller (not shown), and a gamma voltage part 90 for supplying positive and negative gamma voltages required in the DAC array 62.

Each data-driving IC having the configuration as mentioned above performs a time-divisional driving of the DAC array 62 using the MUX1 array 54 and the DEMUX array 84, thereby driving 2n data lines, which are twice the data lines of the related art explained above, using (n+1) DAC's 64 and 66 and (n+1) buffers 70. The present data-driving IC has 2n channel data outputs so as to drive 2n data lines. However, FIG. 4 illustrates only 12 channels D1 to D12 of the 2n channels of the data-driving IC when n is 6, for example. And, the data driver IC drives the data lines by a vertical two-dot inversion scheme, and the charging sequence of the time-divided pixel signals is alternately changed for each at least one horizontal period 1H or more and one frame, thereby improving a picture quality.

The data register 88 interfaces the pixel data from the timing controller to apply the pixel data to the first latch array 46. Particularly, the timing controller divides the pixel data into even pixel data RGBeven and odd pixel data RGBodd for the purpose of reducing a transmission frequency and supplies the divided pixel data through each transmission line to the data register 88. The data register 88 outputs the input even and odd pixel data RGBeven and RGBodd to the first latch array 46 over each transmission line. Herein, each of the even pixel data RGBeven and the odd pixel data RGBodd includes red(R), green(G), and blue(B) pixel data.

The gamma voltage part 90 further divides a plurality of gamma reference voltages from a gamma reference voltage generator (not shown) for each gray level to output the divided gamma reference voltages.

The shift register array 42 generates and applies sequential sampling signals to the first latch array 46. To this end, the shift register array 46 is comprised of 2n/6 (herein, n=6) shift registers 44. The shift register 44 at the first stage shown in FIG. 4 shifts a source start pulse SSP from the timing controller in response to a source sampling clock signal SSC and output the shifted source start pulse as a sampling signal. At the same time, the shift register 44 applies the shifted source start pulse to the shift register 44 at the next stage as a carry signal CAR. The source start pulse SSP is applied for each horizontal period, as shown in FIGS. 5A and 5B, and is shifted for each source sampling clock signal SSC to be outputted as a sampling signal.

The first latch array 46 samples and latches the pixel data RGBeven and RGBodd from the data register 88 by a certain unit in response to the sampling signal from the shift register array 42. The first latch array 46 consists of 2n first latches 48 for latching 2n (herein, for example, n=6) pixel data R, G, and B, each of which has a size corresponding to the bit number (i.e., 3 bits or 6 bits) of the pixel data R, G, and B. Such a first latch array 46 samples and latches the even pixel data RGBeven and the odd pixel data RGBodd (i.e., each 6 pixel data) for each sampling signal, and then outputs the latched data simultaneously.

The second latch array 50 simultaneously latches the pixel data R, G, and B from the first latch array 46 in response to a source output enable signal SOE from the timing controller, and then output the latched data. The second latch array 50 includes 2n (herein, for example, n=6) second latches 52 similar to the first latch array 46. The source output enable signal SOE is generated for each horizontal period, as shown in FIGS. 5A and 5B.

The MUX1 array 54 performs an n time-division on 2n (herein, for example, n=2) pixel data from the second latch array 50 for each H/2 period to output the time-divided pixel data in response to first and second selection control signals θ1 and θ2 from the timing controller. In this case, the MUX1 array 54 alternately changes the output sequence of the pixel data for each at least one horizontal period and each frame, wherein the pixel data is outputted by the H/2 period. To this end, the MUX1 array 54 consists of n MUX1s 56, each of which selects any one output of the two second latches 52 in the second latch array 50. In other words, each of the MUX1s 56 time-divides the outputs of the two second latches 52 for each ½ period to apply the time-divided output. And, each of the MUX1 56 alternately changes the order of selecting and applying the outputs of the second latches 52 for at least one horizontal period and one frame.

More specifically, for the vertical two-dot inversion driving, the odd-numbered MUX1 56 selects any one of the outputs of the two odd-numbered second latches 52 in response to the first selection control signal θ1 while the even-numbered MUX1 56 selects any one of the outputs of the two even-numbered second latches 52 in response to the second selection control signal θ2. The first and second selection control signals θ1, θ2 are opposite to one another, as shown in FIGS. 5A and 5B. And, the first and second selection control signals θ1, θ2 have their polarities inverted for each horizontal period and each frame, as shown in FIGS. 5A and 5B, in order to change the supplying sequence of the pixel data for one horizontal period and one frame.

For example, the first MUX1 56 selects to output a first pixel data from the first second latch 52 at the first half of a horizontal period, and a third pixel data from the third second latch 52 at the second half, in response to the first selection control signal θ1. The first MUX1 56 selects to output the third pixel data from the third second latch 52 at the first half of the next horizontal period, and the first pixel data from the first second latch 52 at the second half. Similarly, the second MUX1 56 selects to output a second pixel data from the second latch 52 at the first half of the horizontal period, and a fourth pixel data from the fourth second latch 52 at the second half, in response to the second selection control signal θ2. The second MUX1 56 selects to output the fourth pixel data from the fourth second latch 52 at the first half of the next horizontal period, and the second pixel data from the second second latch 52 at the second half.

The MUX2 array 58 determines a path of the pixel data R, G, and B supplied from the MUX1 array 54 in response to a polarity control signal POL from the timing controller. To this end, the MUX2 array 54 includes (n−1) MUX2s 60. Each of the MUX2s 60 receives the output signals of the two adjacent MUX1s 56 to selectively output the received signals in response to the polarity control signal POL. Herein, the outputs of the remaining MUX1s 56 excluding the first and last MUX1s 56 are commonly inputted to the two adjacent MUX2s 60. The outputs of the first and last MUX1s 56 are commonly inputted to the PDAC 66 and the MUX2 60. The MUX2 array 58 having the configuration as mentioned above allows the pixel data R, G, and B received from each MUX1 56 to be progressed into the DAC array 62 as they are, or to be progressed into the DAC array 62 with being shifted toward the right side by one channel in response to the polarity control signal POL. The polarity control signal POL has a polarity inverted for each two horizontal periods, as shown in FIGS. 5A and 5B, for a vertical two-dot inversion driving. Accordingly, the MUX2 array 58 allows each pixel data R, G, and B from the MUX1 array 54 to be outputted to PDAC's 64 or NDAC's 66 alternately arranged in the DAC array 62 for each two horizontal periods, or to be shifted toward the right side by one channel and outputted.

For instance, in a first and a second horizontal period, the first and third pixel data sequentially outputted from the first MUX1 56 are directly supplied to the PDAC1 66 without passing through the MUX2 60, whereas the second and fourth pixel data sequentially outputted from the second MUX1 56 are supplied to the NDAC1 64 through the first MUX2 60. Subsequently, in a third and a fourth horizontal period, the first and third pixel data are supplied to the NDAC1 64 through the first MUX2 60, whereas the second and fourth pixel data are supplied to the PDAC2 66 through the second MUX2 60.

The DAC array 62 converts the pixel data R, G, and B from the MUX2 array 58 into pixel signals by using positive and negative gamma voltages GH and GL received from the gamma voltage part 90 to output the pixel signals. To this end, the DAC array 62 includes (n+1) number of PDAC's 66 and NDAC's 64, which are alternately arranged in parallel to each other for a dot inversion driving. The PDAC 66 converts the pixel data R, G, and B from the MUX2 array 58 into positive pixel signals using the positive gamma voltages GH. On the other hand, the NDAC 64 converts the pixel data R, G, and B from the MUX2 array 58 into negative pixel signals using the negative gamma voltages GL. Such PDAC 66 and NDAC 64 convert the digital pixel data inputted for each ½ horizontal period into analog pixel signals.

For instance, the PDAC1 66 converts odd pixel data [1,1] and [1,3] inputted time-divisionally in each of the first and second horizontal periods into pixel signals, as shown in FIGS. 5A and 5B, to output the converted data. At the same time, the NDAC2 also converts even pixel data [1,2] and [1,4] inputted time-divisionally in each of the first and second horizontal periods into pixel signals, as shown in FIGS. 5A and 5B, to output the converted data. Then, in each of a third and a fourth horizontal period, the NDAC2 64 converts odd pixel data [2,1] and [2,3] inputted time-divisionally into pixel signals to output the converted data. At the same time, the PDAC 66 converts even pixel data [2,2] and [2,4] inputted time-divisionally in each of the third and fourth horizontal periods into pixel signals to output the converted data. By such a DAC array 62, 2n pixel data are time-divided n by n for each ½ horizontal period to be converted into pixel signals and then outputted.

Each of (n+1) buffers 70 included in the buffer array 68 buffers and outputs a pixel signal from each of the PDAC's 66 and the NDAC's 64 of the DAC array 62.

The MUX3 array 80 determines a path of each pixel signal from the buffer array 68 in response to the polarity control signal POL from the timing controller. To this end, the MUX3 array 80 includes n (herein, for example, n=6) MUX3s 82. Each of the MUX3s 82 selects any one output of the two adjacent buffers 70 in response to the polarity control signal POL. Herein, the outputs of the remaining buffers 70 excluding the first and last buffers 70 are commonly inputted to the two adjacent MUX3s 82. The MUX3 array 82 having the configuration as mentioned above allows the pixel signals from the buffers 70 excluding the last buffer 70 to be outputted as they are at a corresponding one-to-one relationship in response to the polarity control signal POL. Further, the MUX3 array 82 allows the pixel signals from the remaining buffers 70 excluding the first buffer 70 to be shifted toward the left side by one channel and outputted to the DEMUXs 86 at a corresponding one-to-one relationship in response to the polarity control signal POL. The polarity control signal POL, for a vertical two-dot inversion driving, has a polarity inverted for each two horizontal periods, as shown in FIGS. 5A and 5B, similar to the MUX2 array 58. As mentioned above, the MUX3 array 80, along with the MUX2 array 58, determines polarities of the pixel signals in response to the polarity control signal POL. As a result, the pixel signal outputted from the MUX3 array 80 has a polarity opposite to the adjacent pixel signals and has its polarity inverted for each two horizontal periods.

The DEMUX array 84 selectively applies the pixel signals from the MUX3 array 80 to 2n data lines in response to the first and second selection control signals θ1 and θ2 from the timing controller. To this end, the DEMUX array 84 consists of n DEMUXs 86, each of which performs a time-division on the pixel signal from each MUX3 82 to apply the time-divided signal to two data lines. More specifically, the odd-numbered DEMUXs 86 perform a time-division on the output signals of the odd-numbered MUX3s 82 in response to the first selection control signal θ1 to apply the time-divided signals to two odd-numbered data lines. The even-numbered DEMUXs 86 perform a time-division on the output signals of the even-numbered MUX3s 82 in response to the second selection control signal θ2 to apply them to two even-numbered data lines. The first and second selection control signals θ1 and θ2, as illustrated in FIGS. 5A and 5B, have a polarity opposite to each other and inverted for each horizontal period similar to those applied to the MUX1 array 54 in order to invert the output sequence of the pixel signals for each horizontal period and each frame.

For example, the first DEMUX 86 selectively applies an output of the first MUX3 82 to the first and third data lines D1 and D3 for each ½ horizontal period in response to the first selection control signal θ1, as shown in FIGS. 5A and 5B, and alternately changes the order of outputting the pixel voltage by selecting the pixel voltage for each horizontal period and each frame. Similarly, the second DEMUX 86 selectively applies the output of the second MUX3 82 to the second and fourth data lines D2 and D4 for each ½ horizontal period in response to the second selection control signal θ2, as shown in FIGS. 5A and 5B, and alternately changes the order of outputting the pixel voltage by selecting the pixel voltage for each horizontal period and each frame.

Particularly, the first DEMUX 86 responds to the first selection control signal θ1 to supply the pixel signal [1,1] to the first data line D1 at the first half of the first horizontal period H1 when the first gate line GL1 is activated, and to supply the pixel signal [1,3] to the third data line D3 at the second half of the first horizontal period H1. At the same time, the second DEMUX 86 responds to the second selection control signal θ2 to supply the pixel signal [1,2] to the second data line D2 at the first half of the first horizontal period H1, and to supply the pixel signal [1,4] to the fourth data line D4 at the second half of the first horizontal period H1. And then, the first DEMUX 86 supplies a pixel signal [2,3] to the third data line D3 in response to the first selection control signal θ1 at the first half of the second horizontal period H2 when the second gate line GL2 is activated and supplies a pixel signal [2,1] to the first data line D1 at the second half of the second horizontal period H2. Simultaneously, the second DEMUX 86 supplies a pixel signal [2,4] to the fourth data line D4 at the first half of the second horizontal period H2 in response to the second selection control signal θ2 and supplies a pixel signal [2,2] to the second data line D2 at the second half of the second horizontal period H2.

Figure 6A:
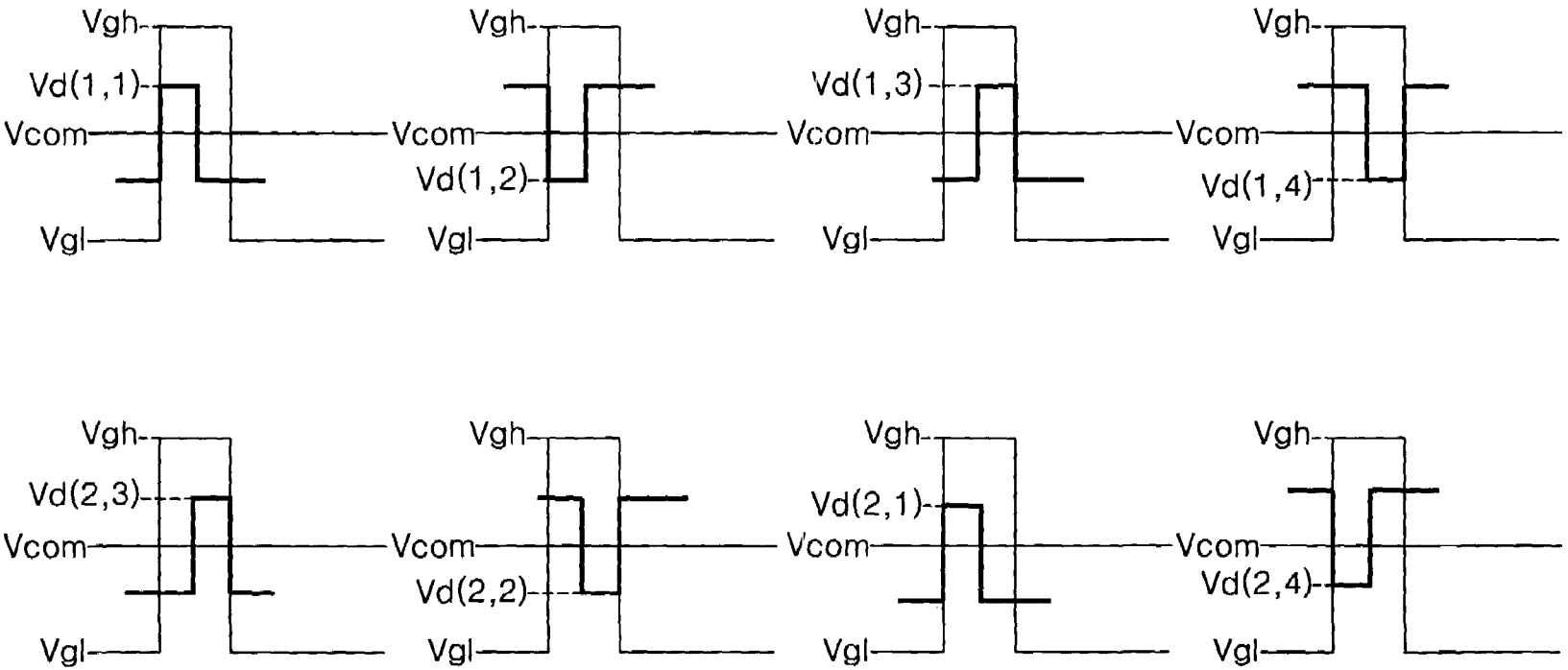
FIGS. 6A and 6B illustrate the charging characteristic of a liquid crystal cell by the driving waveform of FIGS. 5A and 5B.

Accordingly, in the odd-numbered frame, a [1,1] liquid crystal cell is charged with a pixel signal Vd [1,1] from the first data line D1, and a [1,2] liquid crystal cell is charged with a pixel signal Vd [1,2] from the second data line D2 at the first half of the first horizontal period H1 when a gate high voltage Vgh activates the first gate line GL1, as shown in FIG. 6A. And, a [1,3] liquid crystal cell is charged with a pixel signal Vd [1,3] from the third data line D3, and a [1,4] liquid crystal cell is charged with a pixel signal Vd [1,4] from the fourth data line D4 at the second half of the first horizontal period H1. Subsequently, the [2,3] liquid crystal cell is charged with the pixel signal Vd [2,3] from the third data line D3, and the [2,4] liquid crystal cell is charged with the pixel signal Vd [2,4] from the fourth data line D4 at the first half of the second horizontal period H2 when the gate high voltage Vgh activates the second gate line GL2, as shown in FIG. 6A. And, the [2,1] liquid crystal cell is charged with the pixel signal Vd [2,1] from the first data line D1, and the [2,2] liquid crystal cell is charged with the pixel signal Vd [2,2] from the second data line D2 at the second half of the second horizontal period H2.

Figure 6B:
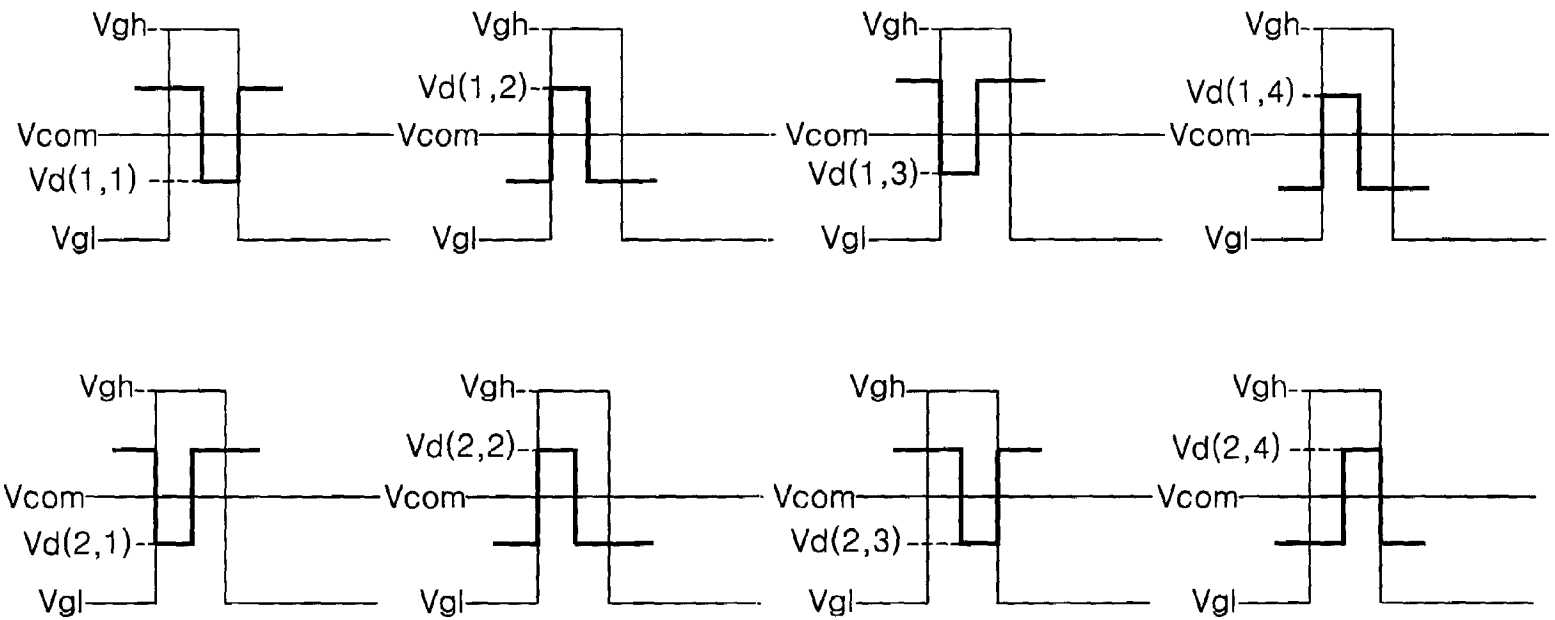

And then, in the even-numbered frame, the [1,3] liquid crystal cell is charged with the pixel signal Vd [1,3] from the third data line D3, and the [1,4] liquid crystal cell is charged with the pixel signal Vd [1,4] from the fourth data line D4 at the first half of the first horizontal period H1 when a gate high voltage Vgh activates the first gate line GL1, as shown in FIG. 6B. And, the [1,1] liquid crystal cell is charged with the pixel signal Vd [1,1] from the first data line D1, and the [1,2] liquid crystal cell is charged with the pixel signal Vd [1,2] from the second data line D2 at the second half of the first horizontal period H1. And then, the [2,1] liquid crystal cell is charged with the pixel signal Vd [2,1] from the first data line D1, and the [2,2] liquid crystal cell is charged with the pixel signal Vd [2,2] from the second data line D2 at the first half of the second horizontal period H2 when the gate high voltage Vgh activates the second gate line GL2, as shown in FIG. 6B. And, the [2,3] liquid crystal cell is charged with the pixel signal Vd [2,3] from the third data line D3, and the [2,4] liquid crystal cell is charged with the pixel signal Vd [2,4] from the fourth data line D4 at the second half of the second horizontal period H2.

The data-driving IC with such a configuration drives the data lines on a time-division basis and drives the data lines of 2n channels in use of (n+1) DAC's, so that the number of data-driving IC can be reduced to at least a half. Further, the data-driving IC alternately changes the supplying sequence (i.e., the charging sequence) of the pixel signals for each horizontal period and each frame, thus compensating the difference of the charging amount of pixel voltage by driving the data lines on a time-division basis. In other words, when driving the data lines on a time-division basis, there occurs a difference in charging amount due to the difference in the charging time between the pixel voltages charged at the first half and the pixel voltages charged at the second half for each horizontal period. However, the difference in charging time can be compensated, as described above, if the charging sequence of the pixel voltage is alternately changed for at least one horizontal period and is alternately changed for each frame.

Specifically, the data-driving IC according to the present invention is driven by a vertical two-dot inversion scheme where the pixel voltage outputted to the odd-numbered data line has an polarity opposite to the pixel voltage outputted to the even-numbered data line and a polarity inversion is made in the pixel voltage of the odd-numbered and even-numbered data lines for each second horizontal period 2H. This is because a flicker phenomenon occurs in specific patterns such as a window shut pattern, as shown in FIGS. 7A to 7B, when the data lines are driven on the time-division basis by the dot inversion scheme.

Figure 7A:
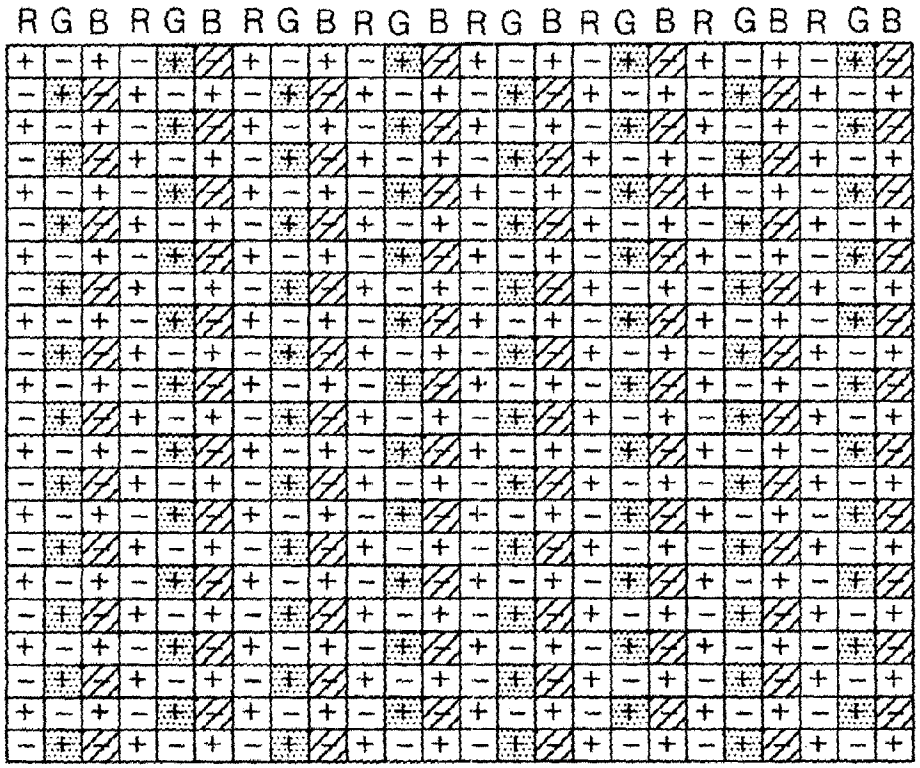
FIGS. 7A and 7B illustrate odd and even frames of a window shut cyan pattern driven by a dot inversion scheme.
Figure 7B:
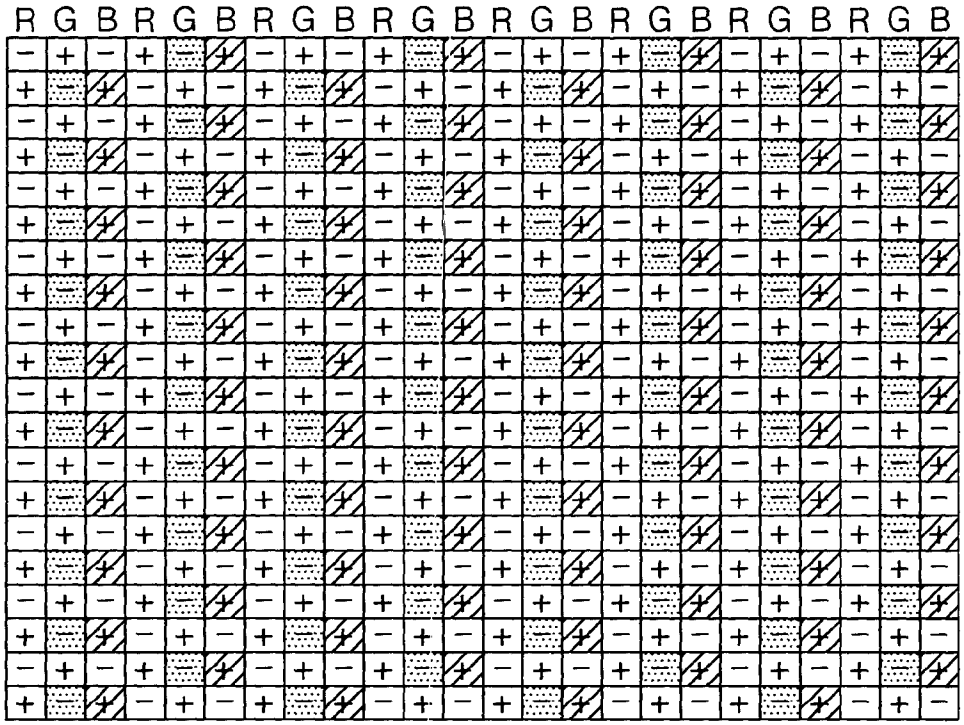

FIGS. 7A and 7B illustrate a cyan dot pattern which is a window shut pattern displayed in a liquid crystal display panel driven by a dot inversion scheme in an odd-numbered frame and an even-numbered frame.

Referring to FIGS. 7A and 7B, green and blue liquid crystal cells G and B emitting light are alternately arranged along a horizontal line to display the cyan dot pattern in the window shut mode. In this case, the green liquid crystal cells G emitting light in the odd-numbered frame are charged with all positive pixel voltage, and the blue liquid crystal cells B are charged with all negative pixel voltage. And, the green liquid crystal cells G emitting light in the even-numbered frame are charged with all negative pixel voltage, and the blue liquid crystal cells B are charged with all positive pixel voltage. Accordingly, there occur flickers by a difference ΔVp between the positive and negative pixel voltage by frames in the green liquid crystal cells G. Conversely, there occur flickers by the difference ΔVp between the negative and positive pixel voltages by frames in the blue liquid crystal cells B as well. In this case, the green liquid crystal cell G and the blue liquid crystal cell B adjacent to each other have polarities opposite from one another, thus there still occurs the flicker phenomenon even though the difference ΔVp is gradually set-off.

Figure 8A:
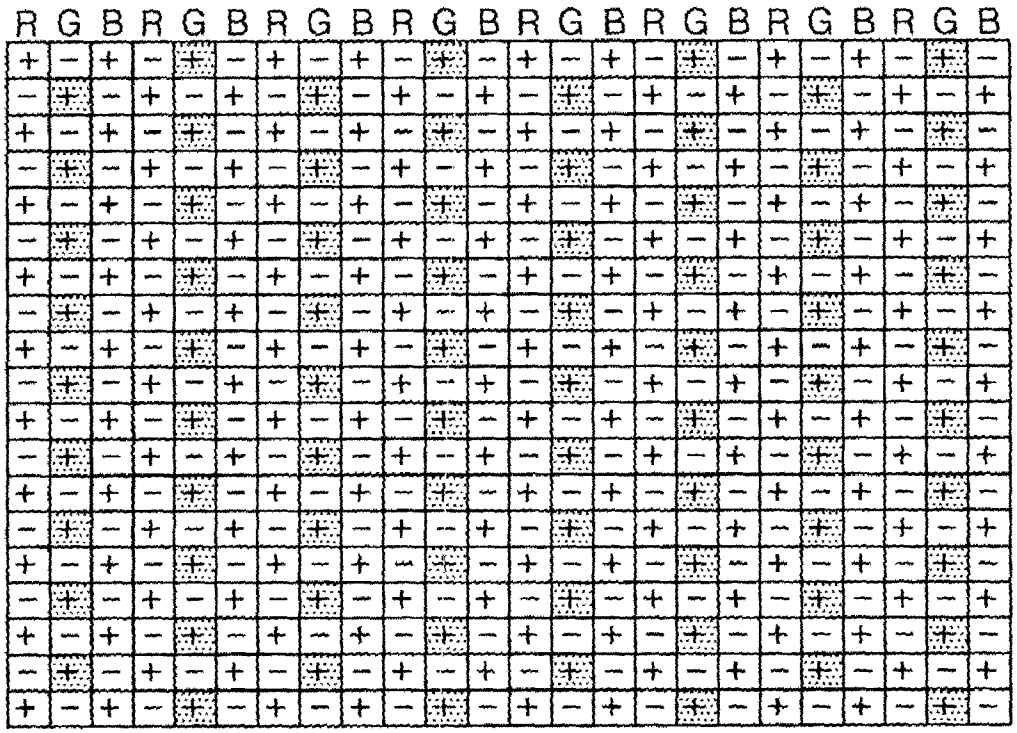
FIGS. 8A and 8B illustrate odd and even frames of a window shut green pattern driven by a dot inversion scheme.
Figure 8B:
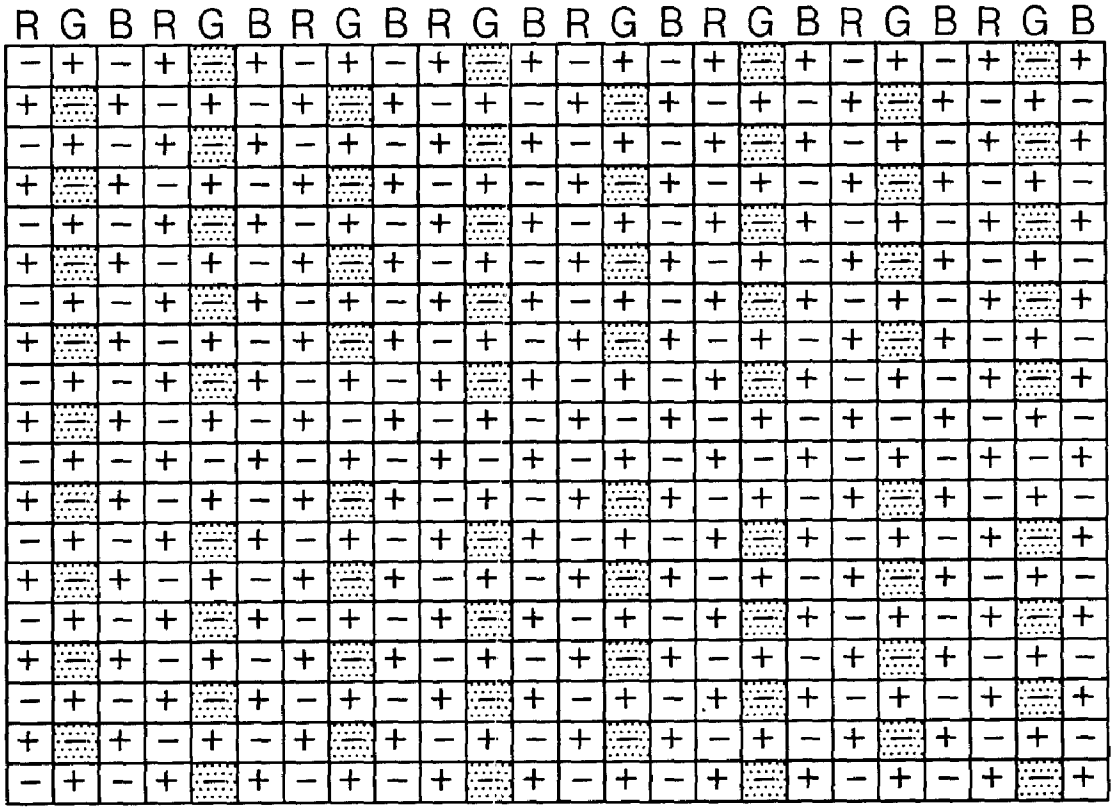

FIGS. 8A and 8B illustrate a green dot pattern which is a window shut pattern displayed in a liquid crystal display panel driven by a dot inversion scheme in an odd-numbered frame and an even-numbered frame.

Referring to FIGS. 8A and 8B, green liquid crystal cells G emitting light are alternately arranged along a horizontal line to display the cyan dot pattern in the window shut mode. In this case, the green liquid crystal cells G emitting light in the odd-numbered frame are charged with all positive pixel voltage, and the blue liquid crystal cells B are charged with all negative pixel voltage. Accordingly, there occur flickers by the difference ΔVp between the positive and negative pixel voltage by frames in the green liquid crystal cells G, and more flickers occur than when displaying the cyan dot pattern.

In the dot inversion scheme, the flicker phenomenon occurs more intensely, when the charging amount difference due to the difference in the charging time between the liquid crystal cells occurs as the data lines are driven on the time-division basis. In order to prevent this, the data-driving IC according to the present invention drives the liquid crystal display panel by the vertical two-dot inversion scheme, as shown in FIGS. 9A to 10B, and alternately changes the charging sequence for each horizontal period and each frame.

Figure 9A:
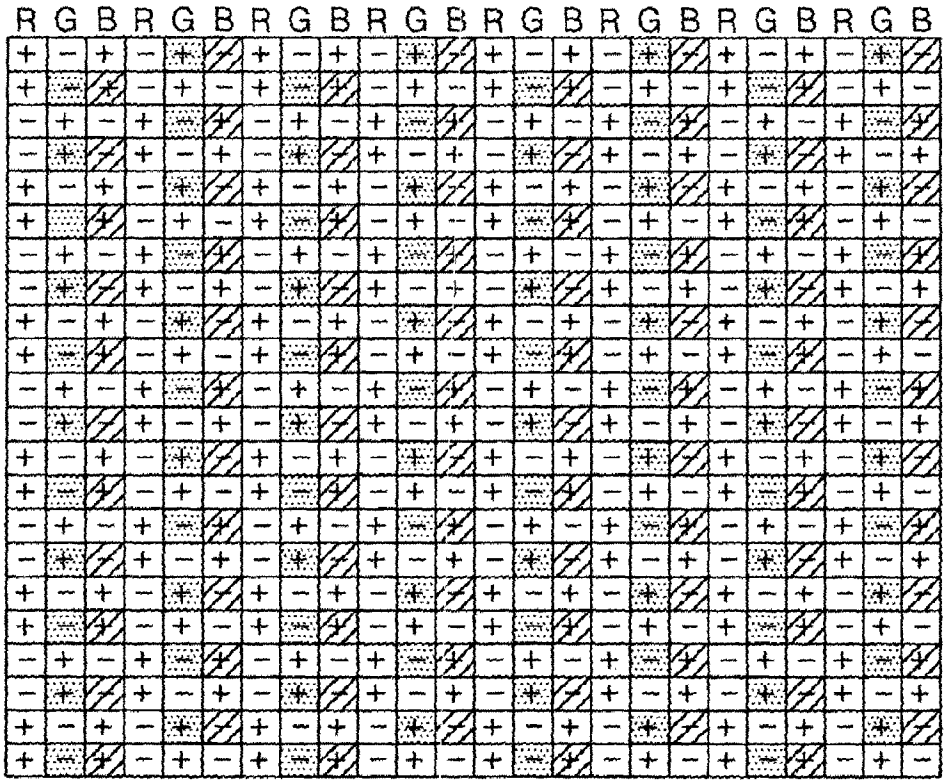
FIGS. 9A and 9B illustrate odd and even frames of a window shut cyan pattern driven by a vertical two-dot inversion scheme.
Figure 9B:
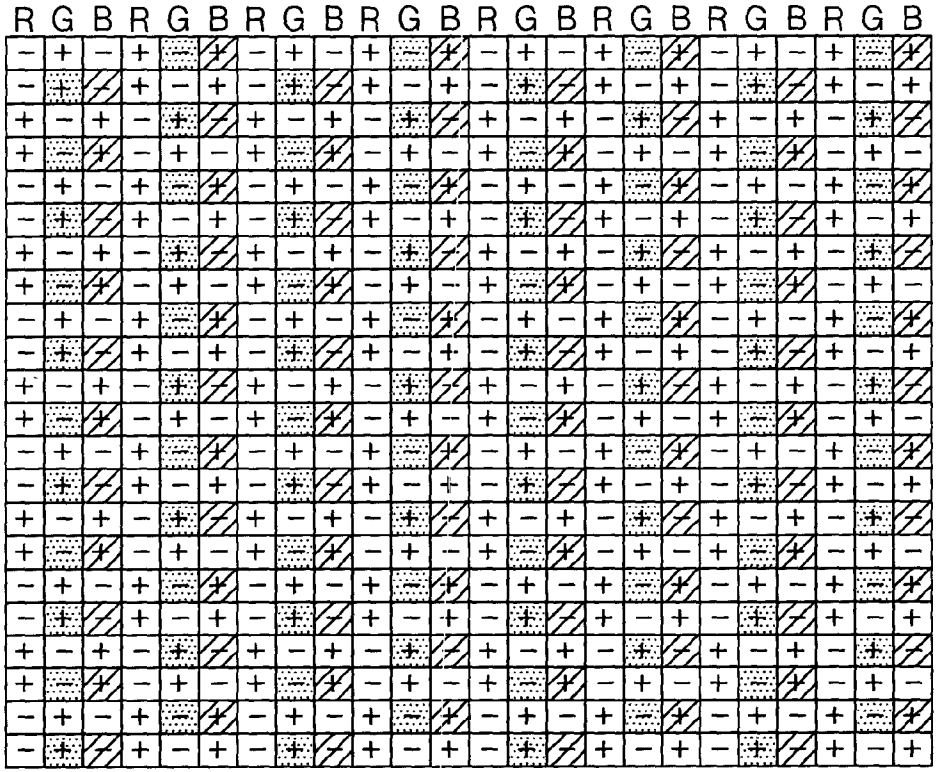

FIGS. 9A and 9B illustrate a cyan dot pattern which is a window shut pattern displayed in a liquid crystal display panel driven by a vertical two-dot inversion scheme in an odd-numbered frame and an even-numbered frame.

Referring to FIGS. 9A and 9B, green and blue liquid crystal cells G and B emitting light are alternately arranged along a horizontal line to display the cyan dot pattern in the window shut mode. In this case, the green liquid crystal cells G charged with positive pixel voltage (+) and the green liquid crystal cells G charged with negative pixel voltage (−) simultaneously exist in the green liquid crystal cells G emitting light in the odd-numbered frame. Further, the blue liquid crystal cells B charged with positive pixel voltage (+) and the blue liquid crystal cells B charged with negative pixel voltage (−) simultaneously exist in the blue liquid crystal cells B emitting light in the odd-numbered frame.

And, the green liquid crystal cells G charged with positive pixel voltage (+) and the green liquid crystal cells G charged with negative pixel voltage (−) simultaneously exist in the green liquid crystal cells G emitting light in the even-numbered frame. Further, the blue liquid crystal cells B charged with positive pixel voltage (+) and the blue liquid crystal cells B charged with negative pixel voltage (−) simultaneously exist in the blue liquid crystal cells B emitting light in the even-numbered frame.

Since the positive and negative pixel voltages equally exist in the green and blue liquid crystal cells G and B emitting light for each frame, the difference ΔVp between the positive pixel voltage and the negative pixel voltage is set-off, thus the flicker phenomenon by the difference ΔVp can be prevented from occurring.

Figure 10A:
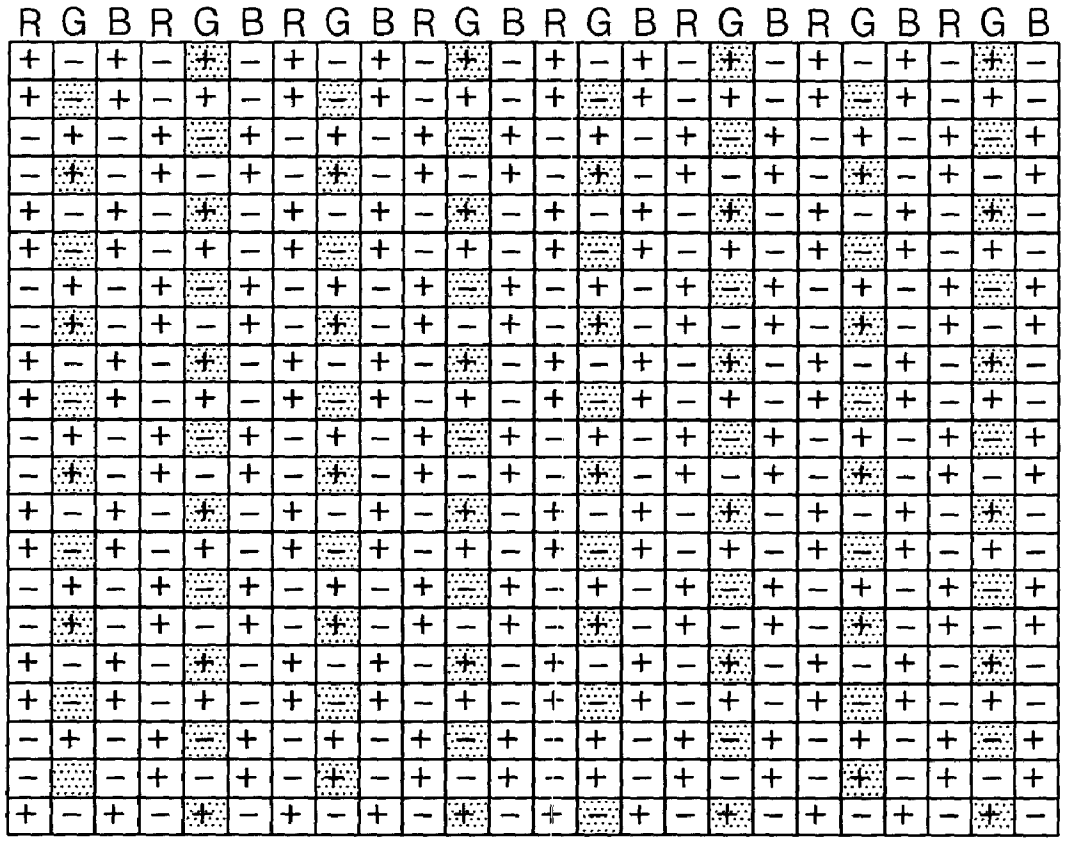
FIGS. 10A and 10B illustrate odd and even frames of a window shut green pattern driven by a vertical two-dot inversion scheme.
Figure 10B:
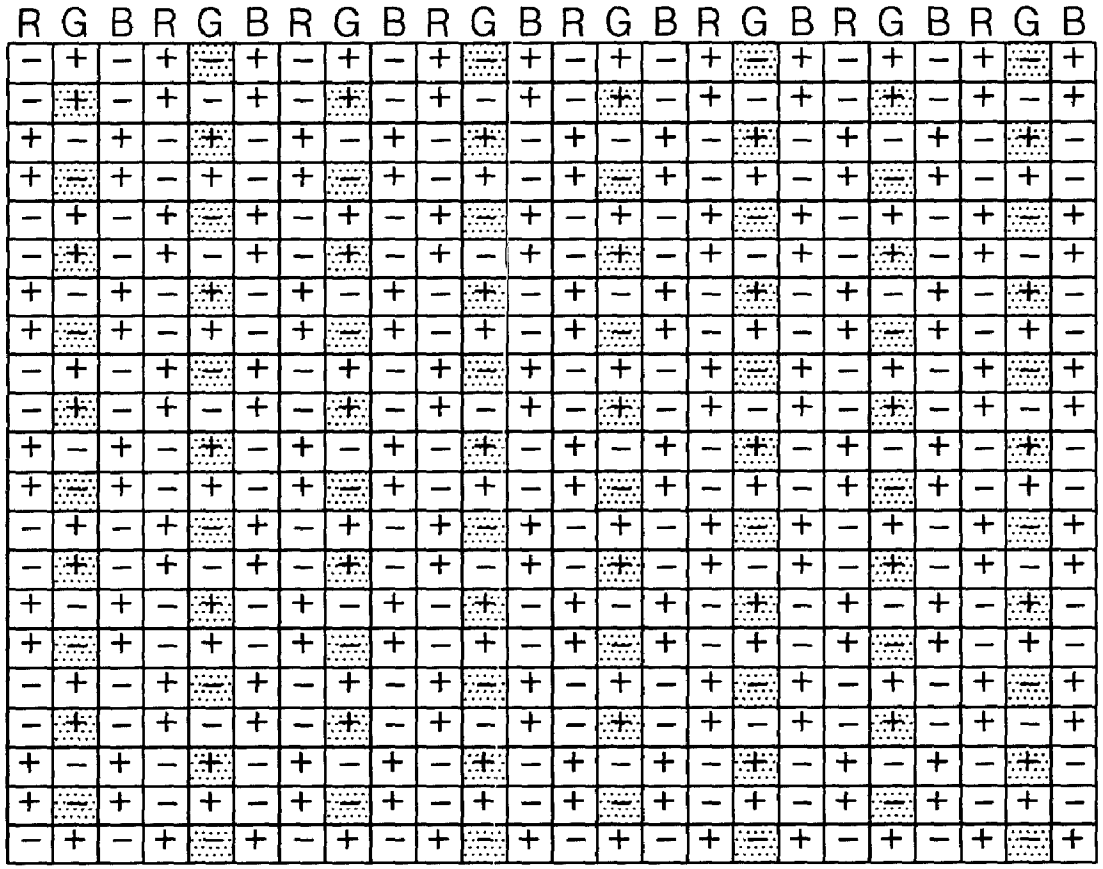

Referring to FIGS. 10A and 10B, green liquid crystal cells G emitting light are alternately arranged along a horizontal line to display the green dot pattern in the window shut mode. In this case, the green liquid crystal cells G charged with positive pixel voltage (+) and the green liquid crystal cells G charged with negative pixel voltage (−) simultaneously exist in the green liquid crystal cells G emitting light in the odd-numbered frame. And, the green liquid crystal cells G charged with positive pixel voltage (+) and the green liquid crystal cells G charged with negative pixel voltage (−) simultaneously exist in the green liquid crystal cells G emitting light in the even-numbered frame.

Since the positive and negative pixel voltages equally exist in the green liquid crystal cells G emitting light for each frame, the difference ΔVp between the positive pixel voltage and the negative pixel voltage is set-off, thus the flicker phenomenon by the difference ΔVp can be prevented from occurring.

Figure 11:
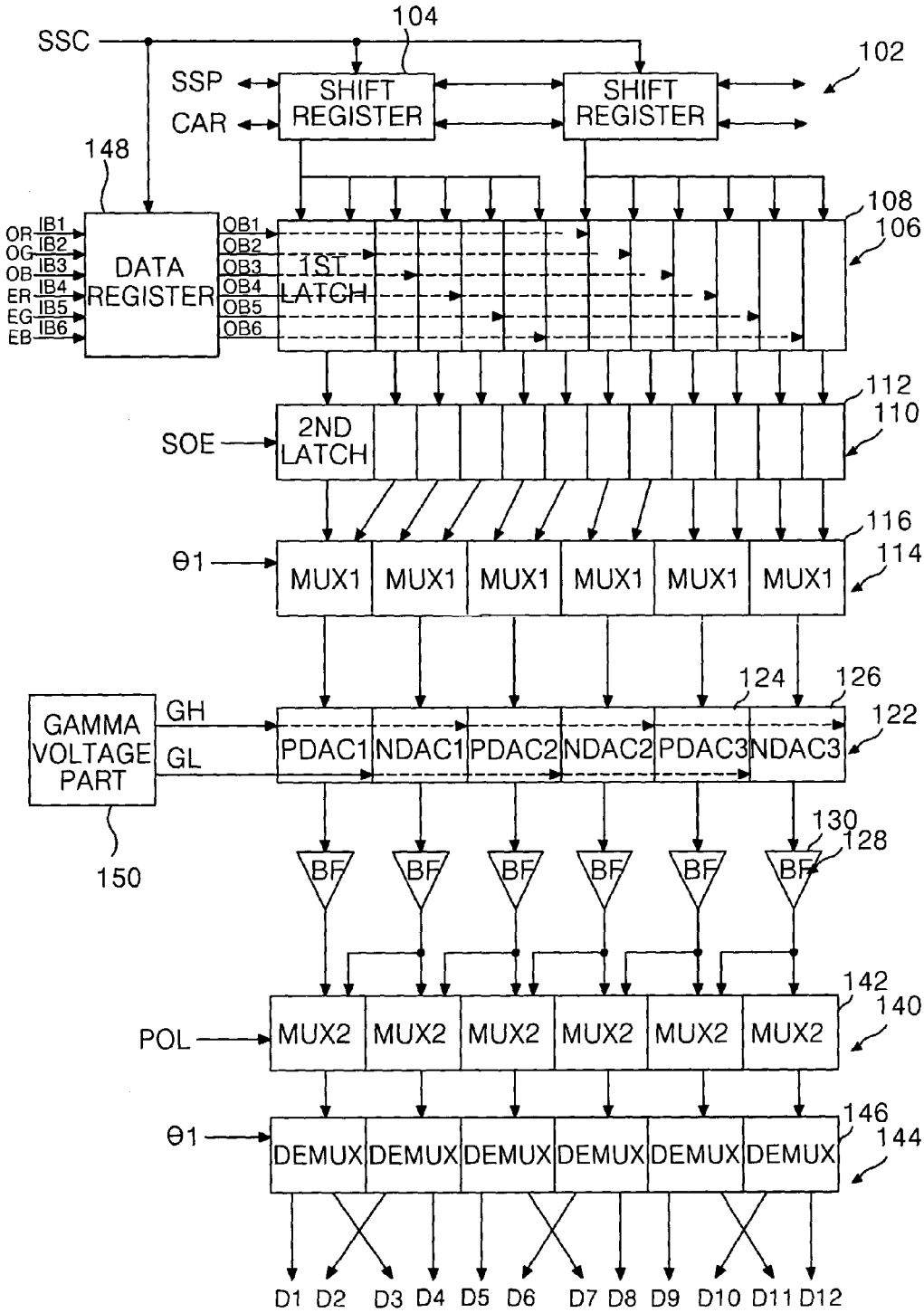
FIG. 11 is a detailed block diagram showing a configuration of a data-driving IC according to a second embodiment of the present invention.
Figure 12A:
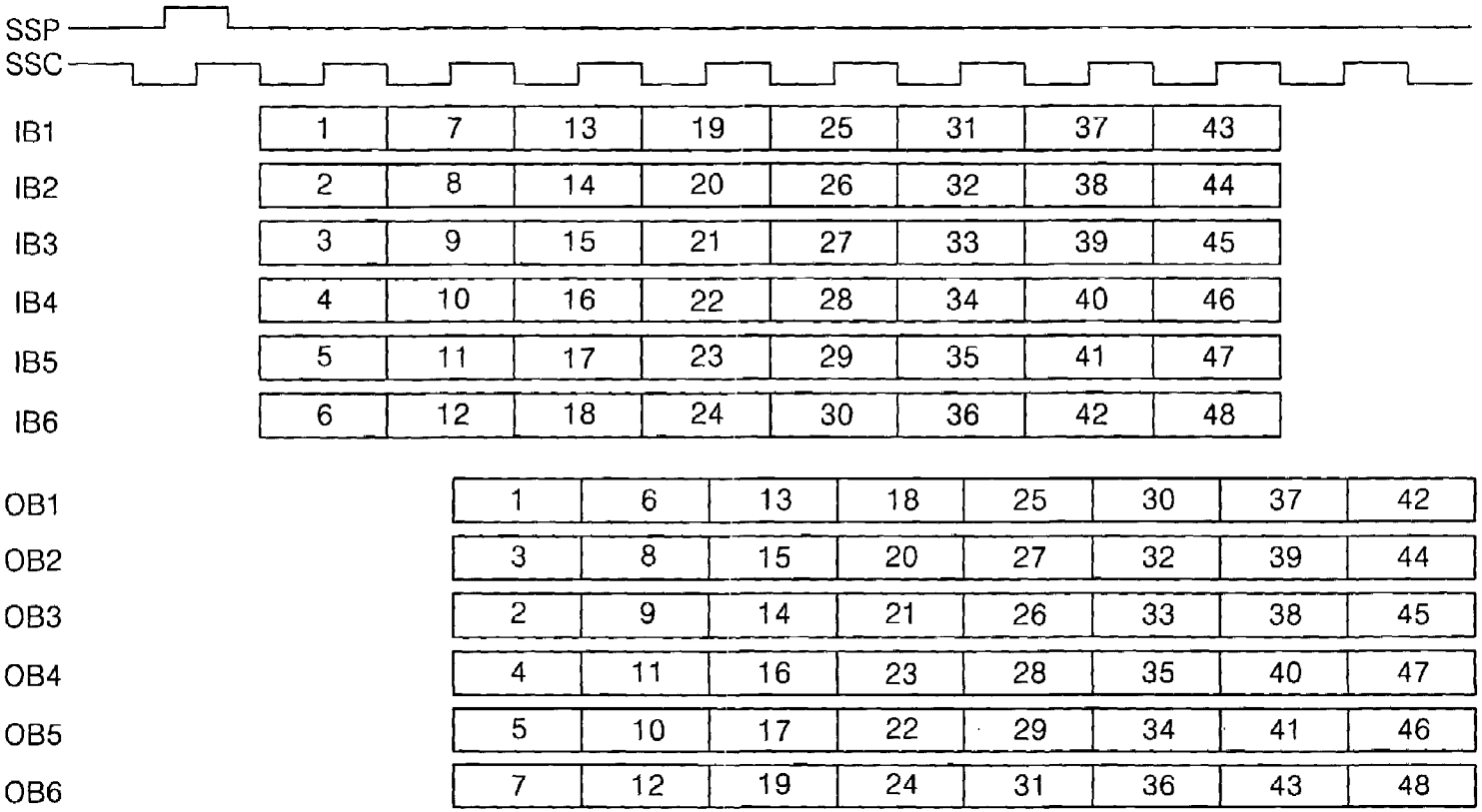
FIGS. 12A and 12B are driving waveform diagrams of the data register of FIG. 11.
Figure 12B:
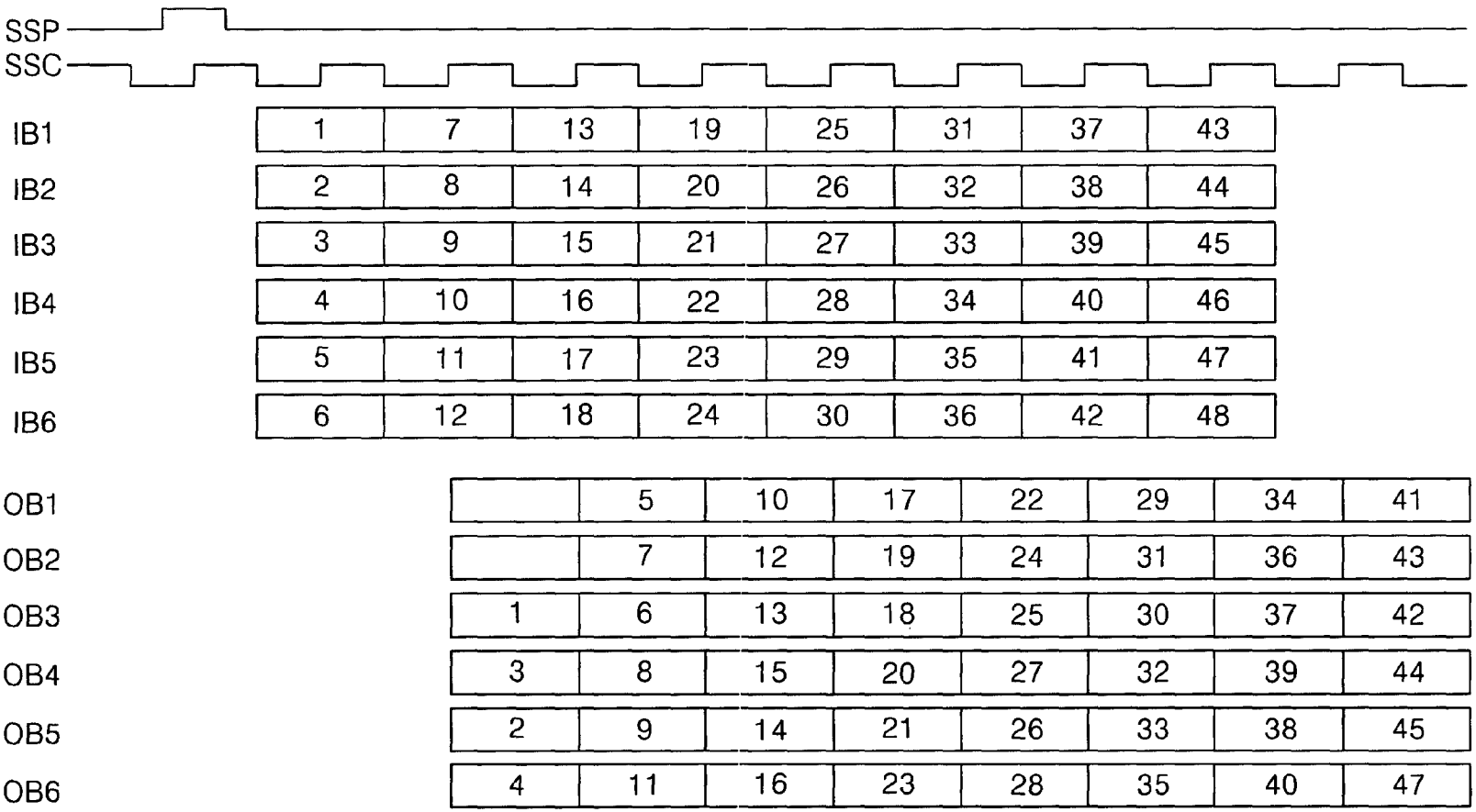
Figure 13A:
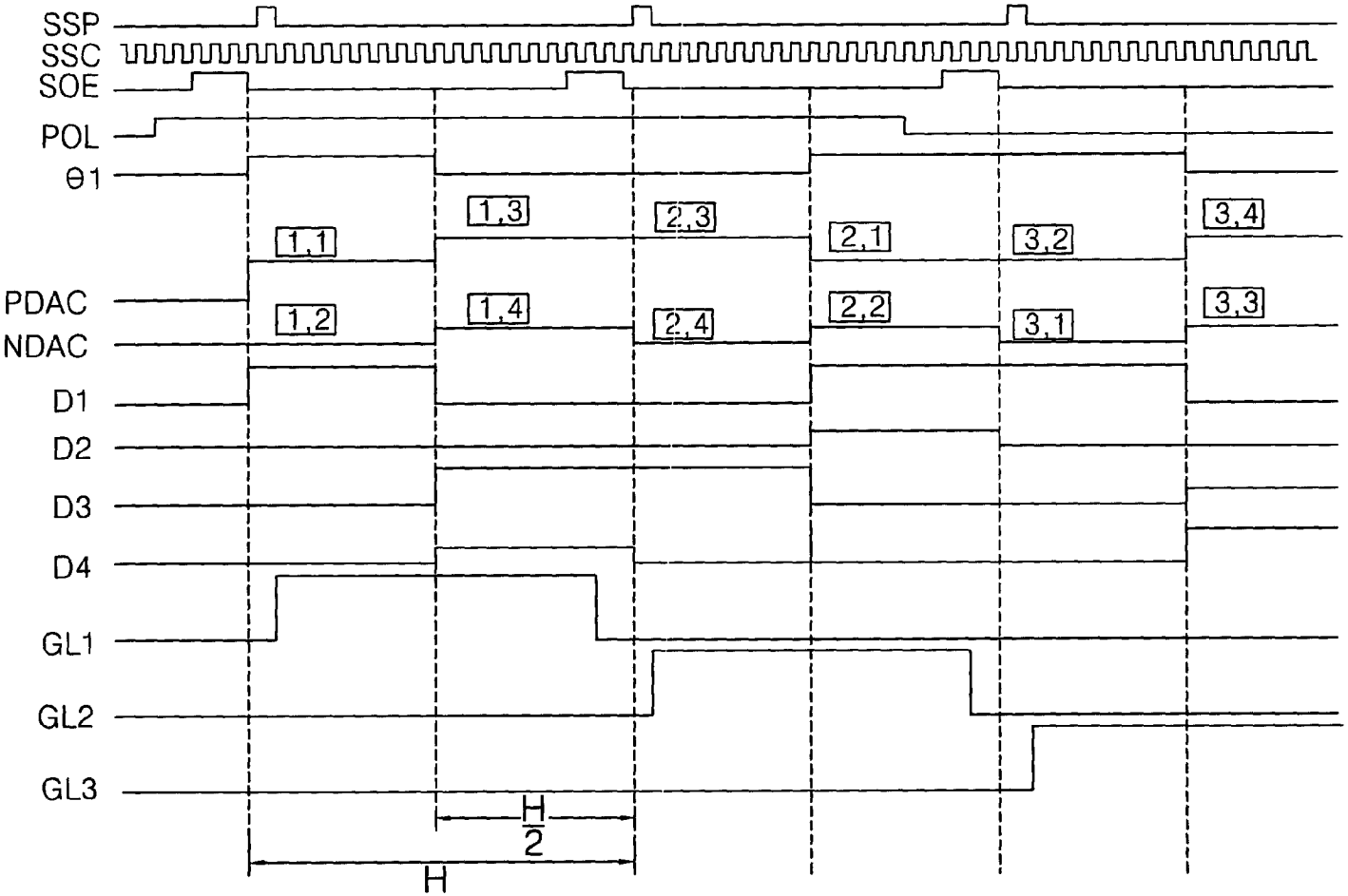
FIGS. 13A and 13B are driving waveform diagrams of odd and even frames of the data-driving IC of FIG. 11.
Figure 13B:
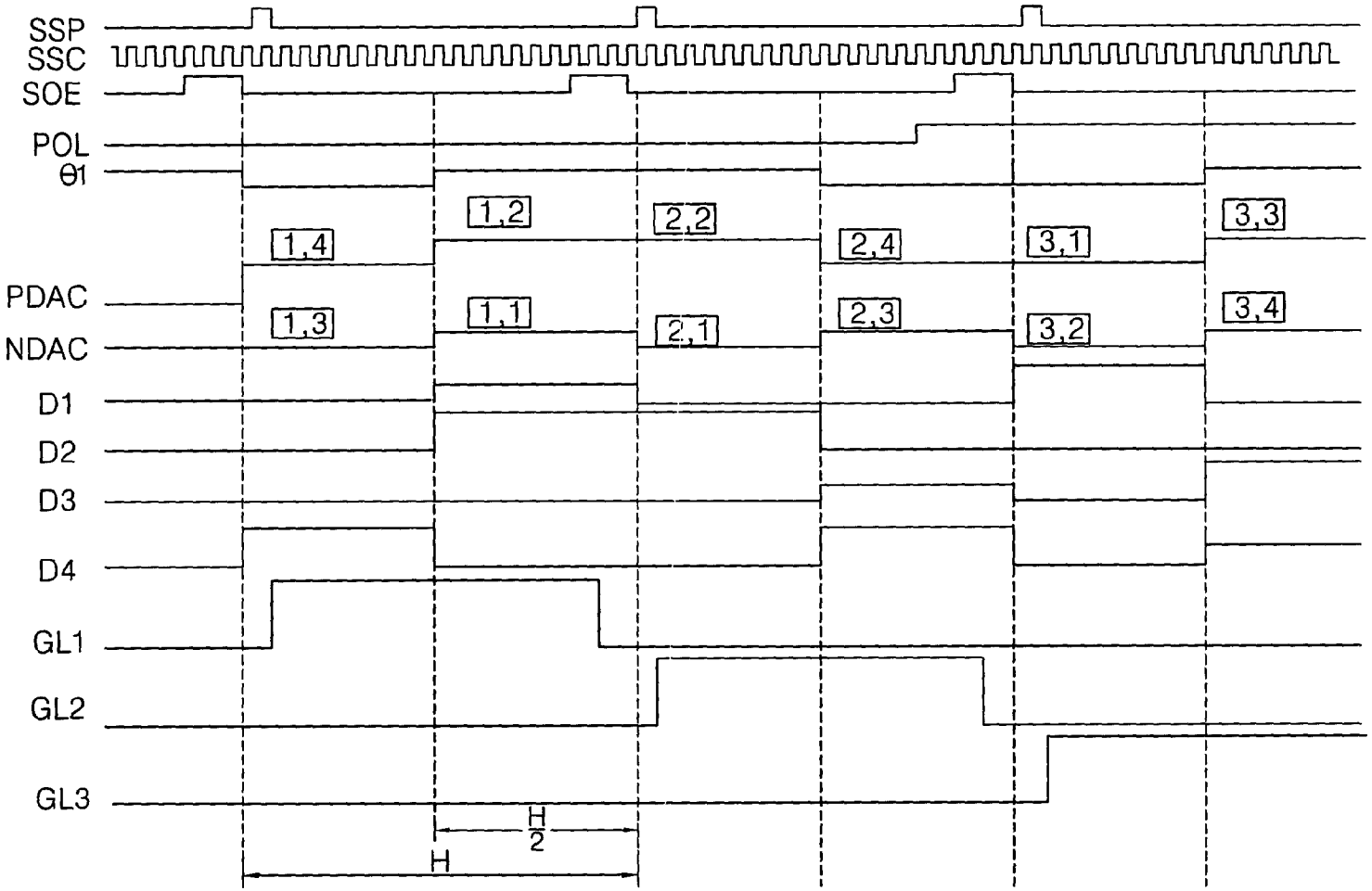

FIG. 11 is a detailed block diagram of a configuration of a data-driving IC of a liquid crystal display device according to a second embodiment of the present invention. FIGS. 13A and 13B are driving waveform diagrams of odd and even frames of the data-driving IC shown in FIG. 11. And, FIGS. 12A and 12B are driving waveform diagrams of the data register 148, shown in FIG. 11, during the $(m-2)^{th}$ horizontal period and the $m^{th}$ horizontal period.

The data-driving IC, as illustrated in FIG. 11, includes a shift register array 102 for applying a sequential sampling signal, first and second latch arrays 106 and 110 for latching and outputting pixel data R, G, and B in response to the sampling signal, a MUX1 array 114 for performing a time-division on the pixel data R, G, and B from the second latch array 110 and outputting the time-divided pixel data, a digital-to-analog converter (DAC) array 122 for converting the pixel data R, G, and B from the MUX1 array 114 into pixel signals, a buffer array 128 for buffering and outputting the pixel signals from the DAC array 122, a MUX2 array 140 for controlling a path of an output of the buffer array 128, and a DEMUX array 144 for performing a time-division on the pixel signals from the MUX2 array 140 to output the time-divided signals to data lines D1 to D2n.

Further, the data-driving IC illustrated in FIG. 11, includes a data register 148 for rearranging and outputting pixel data R, G, and B from a timing controller (not shown), and a gamma voltage part 150 for supplying positive and negative gamma voltages required in the DAC array 122.

Each data-driving IC having the configuration as mentioned above performs a time-divisional driving of the DAC array 122 using the MUX1 array 114 and the DEMUX array 144, thereby driving 2n data lines, which are twice the data lines of the related art, using (n+2) DAC's 124 and 126 and buffers 130. The present data-driving IC has 2n channel data outputs so as to drive 2n data lines. However, FIG. 11 illustrates only 12 channels D1 to D12 of the 2n channels of the data-driving IC when n is 6, for example. And, the data-driving IC alternately changes the charging sequence of the pixel signals for each at least one horizontal period 1H and one frame, and at the same time, drives the data lines by the vertical two-dot inversion scheme, thereby improving the picture quality of an image.

The gamma voltage part 150 further divides a plurality of gamma reference voltages inputted from a gamma reference voltage generator (not shown) by gray levels to output.

The data register 148 appropriately rearranges the pixel data from the timing controller for a vertical two-dot inversion driving to apply the rearranged pixel data to the first latch array 106. The data register 148 receives the odd pixel data OR, OG, and OB and the even pixel data ER, EG, and EB from the timing controller through the first to the sixth input bus IB1 to IB6, simultaneously. And, the data register 148 rearranges the inputted odd pixel data OR, OG, and OB and the even pixel data ER, EG, and EB and outputs the rearranged pixel data through the first to the sixth output buses OB1 to OB6.

More specifically, the data register 148, as shown in FIGS. 12A and 12B, receives the six pixel data OR, OG, OB, ER, EG, and EB through the first to the sixth input buses IB1 to IB6, respectively. In this case, the data register 148 receives six pixel data OR, OG, OB, ER, EG, and EB for each period of shift clock signal SSC on the basis of the source start pulse SSP.

And the data register 148, as shown in FIG. 12A, alternately outputs the $(4k-2)^{th}$ (herein, k is a positive number) data and the $(4k-1)^{th}$ data among the pixel data of one horizontal line portion in the $(m-2)^{th}$ and $(m-2)^{th}$ horizontal periods. For instance, the second data and the third data are exchanged with one another, the sixth data and the seventh data, and the tenth data and the eleventh data are also exchanged with one another to be outputted, as shown in FIG. 12A. This is for inputting each pair of pixel data, which are to be converted to the pixel signal with the same polarity, to each first MUX 116. Since the pixel data OR, OG, OB, ER, EG, and EB inputted from the data register 148 are rearranged to be outputted, the pixel data can eliminate the MUX array that determines the path of the pixel data in accordance with the polarity control signal POL between the first MUX array 114 and the DAC array 122.

Also, in the $m^{th}$ and $(m+1)^{th}$ horizontal periods, the data register 148, as shown in FIG. 12B, exchanges the $(4k-2)^{th}$ (herein, k is a positive number) data and the $(4k-1)^{th}$ data among the pixel data of one horizontal line portion and delays the data by two channels for their polarity inversion. More specifically, the data are shifted to be outputted through the output buses OB1 to OB6. For instance, the data register 148 shifts the first pixel data to the third output bus OB3, the exchanged third pixel data to the fourth output bus OB4, the exchanged second pixel data to the fifth output bus OB5, and the fourth pixel data to the sixth output bus OB6, then outputs the shifted pixel data. And, in the next clock, the fifth pixel data is shifted to the first output bus OB1, the exchanged seventh pixel data to the second output bus OB2, and the exchanged sixth pixel data to the third output bus OB3, the shifted data are then outputted.

In this way, the pixel data ORO, OGO, OBO, ERO, EGO, and EBO rearranged to be outputted at the data register 148 are delayed for a specific time interval as compared to the inputted pixel data OR, OG, OB, ER, EG, and EB in order to secure time for rearrangement, then the pixel data are outputted. In other words, the pixel data are delayed by about ⅔ clock and then outputted.

The shift register array 102 generates and applies sequential sampling signals to the first latch array 106. To this end, the shift register array 102 is comprised of 2n/6 (herein, for example, n=6) shift registers 104. The shift register 104 at the first stage of FIG. 11 shifts a source start pulse SSP from the timing controller in response to a source sampling clock signal SSC and output the shifted source start pulse as a sampling signal, and at the same time applies to the shift register 104 at the next stage as a carry signal CAR. The source start pulse SSP is applied for each horizontal period, as shown in FIGS. 13A and 13B, and is shifted for each source sampling clock signal SSC to be outputted as a sampling signal.

The first latch array 106 samples a set of the six pixel data inputted from the data register 148 through the first to the sixth output buses OB1 to OB6 in response to the sampling signal from the shift register array 102 and latches the sampled pixel data. The first latch array 106 consists of 2n first latches 48 for latching 2n (herein, n=6) pixel data R, G, and B, each of which has a size corresponding to the bit number (i.e., 6 bits or 8 bits) of the pixel data R, G, and B.

Also, the first latch array 106, as shown in FIG. 12B, includes two first latches (not shown) in case it is inputted by being shifted by two channels.

For example, the pixel data are latched in the order of 1, 3, 2, 4, 5, 7, 6, 8, 9, 11, 10, 12, which are rearranged at the data register 148, at the $1^{st}$ first latch 108 to the $12^{th}$ first latch 108 in the $(m-2)^{th}$ and $(m-1)^{th}$ horizontal periods. And, in the $m^{th}$ and $(m+1)^{th}$ horizontal periods, the pixel data rearranged at the data register 148 are shifted by two channels so that blank data are inputted to the first latch 108 and the second latch 108, the pixel data are latched in the order of 1, 3, 2, 4, 5, 7, 6, 8, 9, 11 shifted by two channels to the third latch 108 to the twelfth latch 108. Herein, the tenth and the twelfth pixel data are latched at two latches (not shown).

The second latch array 110 simultaneously latches the pixel data R, G, and B from the first latch array 106 in response to a source output enable signal SOE from the timing controller, and then output the latched pixel data. The second latch array 110 includes 2n (herein, for example, n=6) second latches 112 similar to the first latch array 106. The source output enable signal SOE is generated for each horizontal period, as shown in FIGS. 13A and 13B.

The MUX1 array 114 performs an n time-division on 2n (herein, for example, n=2) pixel data from the second latch array 110 for each H/2 period to output the time-divided pixel data in response to the selection control signal θ1 from the timing controller. In this case, the first MUX array 114 alternately changes the sequence of the pixel data, which are outputted for each H/2 period, for each at least one horizontal and one frame. To this end, the MUX1 array 114 consists of n MUX1s 116. Also, the MUX1 array 114 has one more MUX1 (not shown) considering that the pixel data is shifted by two channels. Each of the MUX1s 116 selects and outputs any one output of the two second latches 112 in the second latch array 110. In other words, each of the MUX1s 112 performs a time-division on the outputs of the two second latches 112 for each ½ period to apply the time-divided output.

More specifically, for a vertical two-dot inversion driving, the odd-numbered MUX1 116 selects any one of the output signals of two adjacent second latches 112 in response to the selection control signal θ1 and outputs the selected signal to the PDAC 124 of the DAC array 122. On the other hand, the even-numbered MUX1 116 selects any one of the output signals of two adjacent second latches 112 in response to the selection control signal θ1 and outputs the selected signal to the NDAC 126 of the DAC array 122. And, each of the MUX1s 116 alternately changes the output selection sequence of the second latches 112 for each at least one horizontal period and one frame. To this end, the polarity of the selection control signal θ1 is inverted for each horizontal period, as shown in FIGS. 13A and 13B.

For example, the first MUX1 116 responds to the selection control signal θ1, in the $(m-2)^{th}$ horizontal period, to select a first pixel data from the first second latch 112 at the first half and a third pixel data from the second second latch 112 at the second half, and then to output the selected data to a PDAC1 124. And then, in the $(m-1)^{th}$ horizontal period, the first MUX1 116, having the output sequence of the pixel data changed in accordance with the selection control signal θ1, selects the third pixel data from the second second latch 112 at the first half and the first pixel data from the first second latch 112 at the second half, and then outputs the selected data to the PDAC1 124.

And, in the $m^{th}$ horizontal period, when the pixel data are shifted by two channels and latched, the second MUX1 116, having the output sequence of the pixel data changed once again in accordance with the selection control signal θ1, selects the first pixel data from the third second latch 112 at the first half and the third pixel data from the fourth second latch 112 at the second half, and then outputs the selected data to a NDAC1 126. And then, in the $(m+1)^{th}$ horizontal period, when the pixel data are shifted by two channels and latched, the second MUX1 116, having the output sequence changed once again in accordance with the selection control signal θ1, selects the third pixel data from the fourth second latch 112 at the first half and the first pixel data from the third second latch 112 at the second half, and then outputs the selected data to the NDAC1 126.

And, in the next frame, the driving method of the $(m-2)^{th}$ and $(m-1)^{th}$ horizontal periods is exchanged with the driving method of the $m^{th}$ and $(m+1)^{th}$ horizontal periods, and the MUX1 array 114 uses the exchanged driving method.

The DAC array 122 converts the pixel data from the MUX1 array 114 into pixel signals by using positive and negative gamma voltages GH and GL from the gamma voltage part 150 to output the pixel signals. To this end, the DAC array 122 includes (n+1) PDAC's 124 and (n+1) NDAC's 126, which are alternately arranged in parallel to one another for a dot inversion driving. The PDAC 124 converts the pixel data from the MUX1 array 114 into positive pixel signals using the positive gamma voltages GH. On the other hand, the NDAC 126 converts the pixel data R, G, and B from the MUX1 array 114 into negative pixel signals using the negative gamma voltages GL. Such PDAC 124 and NDAC 126 carry out an operation of converting the digital pixel data inputted for each ½ horizontal period into analog pixel signals.

For instance, the PDAC1 124 converts the first and third pixel data inputted time-divisionally in each of the $(m-2)^{th}$ and $(m-1)^{th}$ horizontal periods into positive pixel signals, as shown in FIGS. 13A and 13B, to output the converted pixel data. At the same time, the NDAC2 126 also converts the second and fourth pixel data inputted time-divisionally in the $(m-2)^{th}$ and $(m-1)^{th}$ horizontal periods into negative pixel signals, as shown in FIGS. 13A and 13B, to output the converted pixel data. Then, in the $m^{th}$ and $(m+1)^{th}$ horizontal periods each, the NDAC1 126 converts the first and third pixel data inputted time-divisionally into negative pixel signals to output the converted pixel data. At the same time, the PDAC2 124 converts the second and fourth pixel data inputted time-divisionally in each of the $m^{th}$ and $(m+1)^{th}$ horizontal periods into positive pixel signals to output the converted pixel data. By such a DAC array 122, 2n pixel data are time-divided n by n for each ½ horizontal period to be converted into pixel signals and then outputted.

Each of (n+1) buffers 130 included in the buffer array 128 buffers and outputs a pixel signal from each of the PDAC's 124 and the NDAC's 126 of the DAC array 122.

The MUX2 array 140 determines a path of each pixel signal from the buffer array 128 in response to the polarity control signal POL from the timing controller. To this end, the MUX2 array 140 includes n (herein, for example, n=6) MUX2s 142. Each of the MUX2s 142 selects and outputs any one output of the two adjacent buffers 130 in response to the polarity control signal POL. Herein, the outputs of the remaining buffers 130 excluding the first and last buffers 130 are commonly inputted to the two adjacent MUX2s 142. The MUX2 array 142 having the configuration as mentioned above allows the pixel signals from the buffers 130 excluding the last buffer 130 to be outputted as they are at a corresponding one-to-one relationship in response to the polarity control signal POL in each of the $(m-2)^{th}$ and $(m-1)^{th}$ horizontal periods.

Further, the MUX2 array 142 allows the pixel signals from the remaining buffers 130 excluding the first buffer 130 to be outputted to the DEMUXs 146 at a corresponding one-to-one relationship in response to the polarity control signal POL in each of the $m^{th}$ and $(m+1)^{th}$ horizontal periods. Like this, the MUX2 array 140 determines the polarity of the pixel data in response to the polarity control signal POL.

The polarity control signal POL, for a vertical two-dot inversion driving, has a polarity inverted for each second horizontal period 2H, as shown in FIGS. 13A and 13B. As mentioned above, the MUX2 array 140 determines the polarity of the pixel signals in response to the polarity control signal POL. As a result, the pixel signal outputted from the MUX2 array 140 has a polarity opposite to the adjacent pixel signals and has its polarity inverted for each second horizontal period.

The DEMUX array 144 selectively applies the pixel signals from the MUX2 array 140 to 2n (herein, for example, n=6) data lines in response to selection control signal θ1 from the timing controller. To this end, the DEMUX array 144 consists of n DEMUXs 146, each of which performs a time-division on the pixel signal from each MUX2 142 and applies to two data lines.

More specifically, each odd-numbered DEMUX 146 performs a time-division on the output of the odd-numbered MUX2 142 in response to the selection control signal θ1 to apply the time-divided output signals to two odd-numbered data lines. Each even-numbered DEMUX 146 performs a time-division on the output of the odd-numbered MUX2 142 in response to the selection control signal θ2 to apply the time-divided output signals to two even-numbered data lines. As shown in FIGS. 13A and 13B, the selection control signal θ1 has its polarity inverted for each horizontal period in the same way as being applied to the MUX1 array 114, in order to invert the output sequence of the pixel signals for each horizontal period and each frame.

For example, the first DEMUX 146 selectively applies an output of the first MUX2 142 to the first and third data lines D1 and D3 for each ½ horizontal period in response to the selection control signal θ1, as shown in FIGS. 13A and 13B, and alternately changes the sequence of selecting and outputting the pixel voltage for each horizontal period and each frame. Similarly, the second DEMUX 146 selectively applies the output of the second MUX2 142 to the second and fourth data lines D2 and D4 for each ½ horizontal period in response to the selection control signal θ1, as shown in FIGS. 13A and 13B, and alternately changes the sequence of selecting and outputting the pixel voltage for each horizontal period and each frame.

More specifically, in the odd-numbered frame as in FIG. 13A, the first DEMUX 146 supplies a pixel signal [1,1] to the first data line D1 at the first half of the first horizontal period when the first gate line GL1 is activated, and a pixel signal [1,3] to the third data line D3 at the second half. At the same time, the second DEMUX 146 supplies a pixel signal [1,2] to the second data line D2 at the first half of the first horizontal period, and a pixel signal [1,4] to the fourth data line D4 at the second half. And then, the first DEMUX 146 supplies a pixel signal [2,3] to the third data line D3 at the first half of the second horizontal period when the second gate line GL2 is activated, and a pixel signal [2,1] to the first data line D1 at the second half. Simultaneously, the second DEMUX 146 supplies a pixel signal [2,4] to the fourth data line D4 at the first half of the second horizontal period, and a pixel signal [2,2] to the second data line D2 at the second half.

And then, in the even-numbered frame as in FIG. 13B, the first DEMUX 146 supplies the pixel signal [1,3] to the third data line D3 at the first half of the first horizontal period when the first gate line GL1 is activated, and the pixel signal [1,1] to the first data line D1 at the second half. At the same time, the second DEMUX 146 supplies the pixel signal [1,4] to the fourth data line D4 at the first half of the first horizontal period, and the pixel signal [1,2] to the second data line D2 at the second half. And then, the first DEMUX 146 supplies the pixel signal [2,1] to the first data line D1 at the first half of the second horizontal period when the second gate line GL2 is activated, and the pixel signal [2,3] to the third data line D3 at the second half. Simultaneously, the second DEMUX 146 supplies the pixel signal [2,2] to the second data line D2 at the first half of the second horizontal period, and the pixel signal [2,4] to the fourth data line D4 at the second half.

By the data-driving IC having the above-described configuration, polarities of the pixel signals outputted to the odd data lines, such as D1 and D3, etc., are opposite to those of the pixel signals outputted to the even data lines, such as D2 and D4, etc., as shown in FIGS. 13A and 13B. Further, polarities of the odd data lines D1, D3, . . . and the even data lines D2, D4, . . . are inverted and for each of at least two horizontal periods at which the gate lines GL1, GL2, GL3, . . . are sequentially driven and for each frame.

The data-driving IC with such a configuration drives the data lines on a time-division basis and drives 2n channels of data lines using (n+1) DAC, thus the number of data-driving IC's can be reduced to at least a half. Further, the data-driving IC alternately changes the supplying sequence (i.e., charging sequence) of the pixel signals for each horizontal period and each frame, thereby compensating the difference in the charging amount of the pixel voltage by a time-division driving of the data lines. In other words, when driving the data lines on a time-division basis, there occurs a difference in charging amount due to the difference in the charging time between the pixel voltages charged at the first half and the pixel voltages charged at the second half for each horizontal period. However, the difference in charging time can be compensated, as described above, when the charging sequence of the pixel voltage is alternately changed for at least one horizontal period and is alternately changed for each frame. And, the data-driving IC of the present invention drives the liquid crystal display panel by the two-dot inversion scheme, so that the flickers caused by the dot inversion scheme can be prevented.

As described above, in the apparatus and method for data-driving the liquid crystal display device according to the present invention, the data lines are driven time-divisionally to reduce the number of data-driving IC's, thereby reducing the manufacturing cost.

Further, in the apparatus and method for data-driving the liquid crystal display device according to the present invention, the charging sequence of the pixel voltage is alternately changed for each horizontal period and each frame, while it is driven time-divisionally. Accordingly, the difference in charging amount of the pixel voltage caused by the difference in charging time based on a time-divisional driving is compensated to prevent a flicker phenomenon from occurring.

Furthermore, in the apparatus and method for data-driving the liquid crystal display device according to the present invention, the liquid crystal display panel is driven by the vertical two-dot inversion scheme, so as to prevent a flicker phenomenon caused by the dot inversion scheme, as described above.

It will be apparent to those skilled in the art that various modifications and variations can be made in the apparatus and method for data-driving a liquid crystal display device of the present invention without departing from the spirit or scope of the inventions. Thus, it is intended that the present invention covers the modifications and variations of this invention provided they come within the scope of the appended claims and their equivalents.

What is claimed is:

1. A data-driving apparatus for a liquid crystal display device, comprising:

a first multiplexer array performing a time-division on inputted pixel data, alternately changing a supplying sequence of the time-divided pixel data for one horizontal period one frame, and supplying the time-divided pixel data;

a second multiplexer array alternately changing output channels of the pixel data in response to a polarity control signal having a polarity inverted for each of at least two horizontal periods;

a digital-to-analog converter array converting the pixel data into analog pixel signals having a polarity opposite to the pixel data of adjacent channels;

a third multiplexer array alternately changing output channels of the pixel signals for each at least two horizontal periods in response to the polarity control signal; and a demultiplexer array performing a time-division on data lines, alternately changing a supplying sequence of the pixel signals for at least one horizontal period and one frame, and supplying the pixel signals to the time-divided data lines.

2. The data-driving apparatus according to claim 1, further comprising:

a shift register array sequentially generating sampling signals;

a latch array sequentially latching the inputted pixel data in response to the sampling signals and simultaneously outputting the latched pixel data to the first multiplexer array; and a buffer array buffering the pixel signals from the digital-to-analog converter array and applying the buffered pixel signals to the third multiplexer array.

3. The data-driving apparatus according to claim 1, wherein the second multiplexer array outputs unshifted pixel data for the at least two horizontal periods or outputs the pixel data shifted to the right side by one channel.

4. The data-driving apparatus according to claim 1, wherein the third multiplexer array outputs the pixel signals for the at least two horizontal periods without a change or after shifting the pixel data to the left side by one channel.

5. The data-driving apparatus according to claim 1, wherein the digital-to-analog converter array comprises (n+1) number of positive and negative digital-to-analog converters when the demultiplexer array drives 2n data lines, and the positive digital-to-analog converters and the negative digital-to-analog converters are alternately arranged.

6. The data-driving apparatus according to claim 5, wherein the first multiplexer array comprises at least n number of first multiplexers performing an n number of time-division on 2n pixel data and supplying the time-divided pixel data, the second multiplexer array comprises at least (n−1) number of second multiplexers selecting one of outputs of at least two first multiplexers, the third multiplexer array comprises at least n number of third multiplexers selecting one of outputs of at least two digital-to-analog converters, the demultiplexer array comprises at least n number of demultiplexers dividing an output of each third multiplexer and supplying the divided output to at least two data lines, the output of each first multiplexers is commonly inputted to at least two second multiplexers, and the output of each digital-to-analog converters is commonly inputted to at least two third multiplexers.

7. The data-driving apparatus according to claim 6, wherein each odd-numbered first multiplexer selects one of at least two odd-numbered pixel data in response to a first selection control signal and outputs the selected pixel data, and each even-numbered first multiplexer selects one of at least two even-numbered pixel data in response to a second selection control signal and outputs the selected pixel data; and each odd-numbered demultiplexer performs a time-division on a pixel signal from an odd-numbered third multiplexer in response to the first selection control signal and outputs the time-divided pixel signals to at least two odd-numbered data lines, and each even-numbered demultiplexer performs a time-division on a pixel signal from an even-numbered third multiplexer in response to the second selection control signal and outputs the time-divided pixel signals to at least two even-numbered data lines.

8. The data-driving apparatus according to claim 7, wherein the first and second selection control signals have polarities opposite to each other, and the polarities of the first and second selection control signals are inverted for one horizontal period in order to change an output sequence of the pixel data and the pixel signals for the one horizontal period and the one frame.

9. A data-driving apparatus for a liquid crystal display device, comprising:

a data register exchanging pixel data to be supplied to the $(4k-3)^{th}$ (i.e., k is a positive integer) data line among inputted pixel data with pixel data to be supplied to the $(4k-2)^{th}$ data line and realigning the exchanged pixel data;

a first multiplexer array performing a time-division on the pixel data from the data register, alternately changing a supplying sequence of the time-divided pixel data for each horizontal period and each frame, and supplying the time-divided pixel data;

a digital-to-analog converter array converting the pixel data into analog pixel signals having a polarity opposite to pixel data of adjacent channels;

a second multiplexer array alternately changing output channels of the pixel signals in response to a polarity control signal having a polarity inverted for each of at least two horizontal periods; and a demultiplexer array performing a time-division on data lines, alternately changing a supplying sequence of the pixel signals for at least one horizontal period and one frame, and supplying the pixel signals to the time-divided data lines.

10. The data-driving apparatus according to claim 9, wherein the data register outputs the realigned pixel data for the at least two horizontal periods, and delays the realigned pixel data by two channels to output the delayed pixel data for the next at least two horizontal periods.

11. The data-driving apparatus according to claim 9, further comprising:

a shift register array sequentially generating sampling signals;

a latch array sequentially latching the inputted pixel data from the data register in response to the sampling signals and simultaneously outputting the latched inputted pixel data to the first multiplexer array; and a buffer array buffering the pixel signals from the digital-to-analog converter array and applying the buffered pixel signals to the second multiplexer array.

12. The data-driving apparatus according to claim 9, wherein the second multiplexer array outputs unshifted pixel data for the at least two horizontal periods or outputs the pixel data shifted to the left side by one channel.

13. The data-driving apparatus according to claim 9, wherein the digital-to-analog converter array includes (n+1) number of positive and negative digital-to-analog converters when the demultiplexer array drives 2n data lines, and the positive digital-to-analog converters and the negative digital-to-analog converters are alternatively arranged.

14. The data-driving apparatus according to claim 13, wherein the first multiplexer array comprises at least n number of first multiplexers performing an n number of time-division on 2n pixel data in response to a selection control signal and supplying the time-divided pixel data, the second multiplexer array comprises at least n number of second multiplexers selecting one of outputs of at least two digital-to-analog converters in response to a polarity control signal, the demultiplexer array comprises at least n number of demultiplexers dividing an output of each second multiplexer in response to the selection control signal and supplying the divided outputs to at least two data lines, and the output of each digital-to-analog converter is commonly inputted to at least two second multiplexers.

15. The data-driving apparatus according to claim 14, wherein the selection control signal has a polarity inverted for each horizontal period and each frame in order to change an output sequence of the pixel data and the pixel signals.

16. A data-driving method for a liquid crystal display device, comprising:

performing a time-division on inputted pixel data in response to a selection control signal, alternately changing a supplying sequence of the time-divided pixel data for at least one horizontal period and one frame, and supplying the time-divided pixel data;

alternately outputting an unshifted output channel of the pixel data and a shifted output cannel of the pixel data to the right side by one channel in accordance with a polarity control signal having a polarity inverted for at least two horizontal periods;

converting the pixel data into analog pixel voltage signals;

alternately outputting an unshifted output channel of the pixel signals and a shifted output channel of the pixel signals to the left side by one channel, and outputting the pixel signals; and performing a time-division on a plurality of data lines in response to the selection control signal and supplying the pixel signals to the time-divided data lines, and alternately changing a supplying sequence of the pixel signals for at least one horizontal period and one frame and supplying the pixel signals.

17. The data-driving method according to claim 16, further comprising, sequentially generating sampling signals prior to the performing a time-division on the pixel data and supplying the time-divided pixel data;

sequentially latching the pixel data in response to the sample signals, and simultaneously supplying the latched pixel data, and buffering the pixel signals after converting into the pixel signals.

18. The data-driving method according to claim 16, wherein the performing a time-division on the pixel data, comprises separating the pixel data into odd-numbered pixel data and even-numbered pixel data and performing a time-division on the separated pixel data.

19. The data-driving method according to claim 16, wherein the performing a time-division on the data lines, comprises separating the data lines into odd-numbered data lines and even-numbered data lines and performing a time-division on the separated data lines.

20. A data-driving method for a liquid crystal display device, comprising:

exchanging pixel data to be supplied to the $(4k-3)^{th}$ (i.e., k is a positive integer) data line among inputted pixel data with pixel data to be supplied to the $(4k-2)^{th}$ data line and realigning the exchanged pixel data;

performing a time-division on the realigned pixel data in response to a selection control signal, alternately changing a supplying sequence of the time-divided pixel data for each horizontal period and each frame, and supplying the time-divided pixel data;

converting the pixel data into analog pixel voltage signals having polarities opposite to pixel data of adjacent channels;

alternately outputting an unshifted output channel of the pixel signals and a shifted output channel of the pixel signals to the left side by one channel in accordance with a polarity control signal having a polarity inverted for at least two horizontal periods, and outputting the pixel signals; and performing a time-division on a plurality of data lines in response to the selection control signal and supplying the pixel signals to the time-divided data lines, and alternately changing a supplying sequence of the pixel signals for at least one horizontal period and one frame and supplying the pixel signals.

21. The data-driving method according to claim 20, further comprising, sequentially generating sampling signals prior to performing a time-division on the pixel data and supplying the time-divided pixel data, sequentially latching the realigned pixel data in response to the sample signals, and simultaneously applying the latched pixel data, and buffering the pixel signals after converting into the pixel signals.

22. The data-driving method according to claim 20, wherein the realigning the pixel data, further comprises outputting the realigned pixel data for at least two horizontal periods, and delaying the realigned pixel data by two channels to output the delayed pixel data for the next at least two horizontal periods.

23. The data-driving method according to claim 22, wherein the selection control signal has a polarity inverted for each horizontal period.

24. A data-driving method for a liquid crystal display device, comprising:

performing a time-division on inputted pixel data in response to a selection control signal, alternately changing a supplying sequence of the time-divided pixel data for at least one horizontal period and one frame, and supplying the time-divided pixel data;

alternately outputting unshifted pixel data and shifted pixel data in response to a polarity control signal having a polarity inverted for each of at least two horizontal periods; and performing a time-division on a plurality of data lines in response to the selection control signal and supplying the pixel data to the time-divided data lines, and alternately changing a supplying sequence of the pixel data for at least one horizontal period and one frame and supplying the pixel data.

* * * * *